US006226468B1

(12) United States Patent
Tsukamoto et al.

(10) Patent No.: US 6,226,468 B1
(45) Date of Patent: May 1, 2001

(54) IMAGE FORMING METHOD AND APPARATUS HAVING A RATIO OF A THICKNESS OR A WEIGHT PER UNIT AREA BETWEEN LIQUID DEVELOPER ON A DEVELOPING DEVICE AND IMAGE CARRIER BEING SMALLER THAN ABOUT 0.71

(75) Inventors: Takeo Tsukamoto, Kawasaki; Makoto Obu, Yokohama, both of (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/350,133

(22) Filed: Jul. 9, 1999

(30) Foreign Application Priority Data

Jul. 10, 1998 (JP) ..... 10-211809

(51) Int. Cl.[7] ..... G03G 15/08
(52) U.S. Cl. ..... 399/57; 399/55
(58) Field of Search ..... 399/55, 57, 249, 399/237, 239, 240, 241

(56) References Cited

U.S. PATENT DOCUMENTS 5,028,964 * 7/1991 Landa et al. ..... 399/249 X
5,652,080 7/1997 Yoshino et al. .
5,666,616 9/1997 Yoshino et al. .
5,953,559 * 9/1999 Obu ..... 399/110
6,029,036 * 2/2000 Itaya et al. ..... 399/239

FOREIGN PATENT DOCUMENTS 50-99157 8/1975 (JP) .
7-209922 8/1995 (JP) .

* cited by examiner

*Primary Examiner*—Quana M. Grainger
(74) *Attorney, Agent, or Firm*—Oblon, Spivak, McClelland, Maier & Neustadt, P.C.

(57) ABSTRACT

A testing method for a liquid developer which adjusts a narrow gap formed between circumferences of two moving elements, applies different electric potentials to surfaces of the two moving elements to generate an electric field at the narrow gap, and applies the liquid developer to at least one of the two moving elements at a position upstream from the narrow gap in a moving direction of the two moving elements. Further, the method measures one of 1) a thickness, 2) a weight per unit area, and 3) a volume per unit area of liquid developer adhered to the circumferences of the two moving elements at a position downstream from the narrow gap in the moving direction of the moving elements, and calculates a ratio of one of 1) the thicknesses, 2) the weights, and 3) the volumes of the liquid developer between the two moving elements according to a measuring result in the measuring step.

18 Claims, 16 Drawing Sheets

30
31a
32
31b
LD 30
32
31a,31b
LD
D1
A
P

IMAGE FORMING METHOD AND APPARATUS HAVING A RATIO OF A THICKNESS OR A WEIGHT PER UNIT AREA BETWEEN LIQUID DEVELOPER ON A DEVELOPING DEVICE AND IMAGE CARRIER BEING SMALLER THAN ABOUT 0.71

BACKGROUND OF THE INVENTION

1. Field of the Invention

The present invention relates to a method of testing a liquid developer, a liquid developer selected based on the testing method, and an image forming method and an apparatus, such as a photocopier, a facsimile machine, a printer, and the like using the selected liquid developer. The liquid developer includes improved characteristics, such as a decreased background soiling and an increased image density.

2. Discussion of the Background

As one electrophotographic image forming method, a liquid developing method is known, in which liquid developer is supplied to a narrow gap between a photoconductive member (electrostatic latent image bearer) and a liquid developer bearer, such as a developing roller or a developing belt. Thereby, solid toner particles in the liquid developer move toward and adhere onto a latent image carried on the photoconductive member to form a toner image. Such a developing method is referred to as "a narrow gap developing method." In general, an electrophotographic liquid image forming method providing a narrow gap developing method achieves a quality sharp image.

Japanese Laid-open Patent Publication No. 99157/1975 describes an electrophotographic liquid image forming method in which a dielectric release liquid is first applied to a latent electrostatic image on a charge-carrying surface. The latent electrostatic image is then developed with a dielectric cohesive ink by a developing roller or a developing belt coated with the same or a different dielectric release liquid. The developing roller and the developing belt are arranged apart from the charge-carrying surface by a narrow gap.

Japanese Laid-open Patent Publication No. 209922/1995 describes a liquid image forming method using a narrow gap developing method. A pre-wetting liquid is first applied to an electrostatic latent image on a photoconductive member. The latent image is developed with a liquid developer by a developing belt, which is arranged apart from the photoconductive member by a narrow gap.

The above dielectric release and pre-wetting, liquid methods make toner particles in the liquid developer not adhere to a non-image portion of the latent image on the charge carrying surface or the photoconductive member surface, and thereby background soiling on a recording medium is decreased. In addition, a replenishment and application mechanism for the liquid is required to supply the dielectric release or pre-wetting liquid. Accordingly, the production cost is increased for an image forming apparatus using such a dielectric release liquid or pre-wetting liquid. Further, the operating cost of the image forming, apparatus is increased due to the dielectric release liquid or pre-wetting, liquid.

SUMMARY OF THE INVENTION

Accordingly, one object of the present invention is to solve the above-discussed and other problems.

Another object of the present invention is to provide a novel method of testing a liquid developer for characteristics, such as a decreased background soiling and an increased image density.

Yet another object of the present invention is to provide a novel liquid developer, and an image forming apparatus and method using the developer, that forms an improved image with a decreased background soiling and an increased image density without applying a dielectric release liquid or pre-wetting liquid.

These and other objects of the present invention may be achieved by providing a novel liquid developer testing method that adjusts a narrow gap formed between circumferences of two moving elements, applies the different electric potentials to surfaces of the two moving elements to generate an electric field at the narrow gap, and applies the liquid developer to at least one of the two moving elements at a position upstream to the narrow gap in a moving direction of the moving elements. The method also includes measuring one of a thickness, a weight per unit area, and a volume per unit area of liquid developer adhered to the circumferences of the moving elements in a moving direction of the moving elements, and calculating a ratio of the thicknesses, weights, or volumes of the liquid developer between the two moving elements according to the measuring result in the measuring step.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DESCRIPTION OF THE PREFERRED EMBODIMENT

Figure 1:
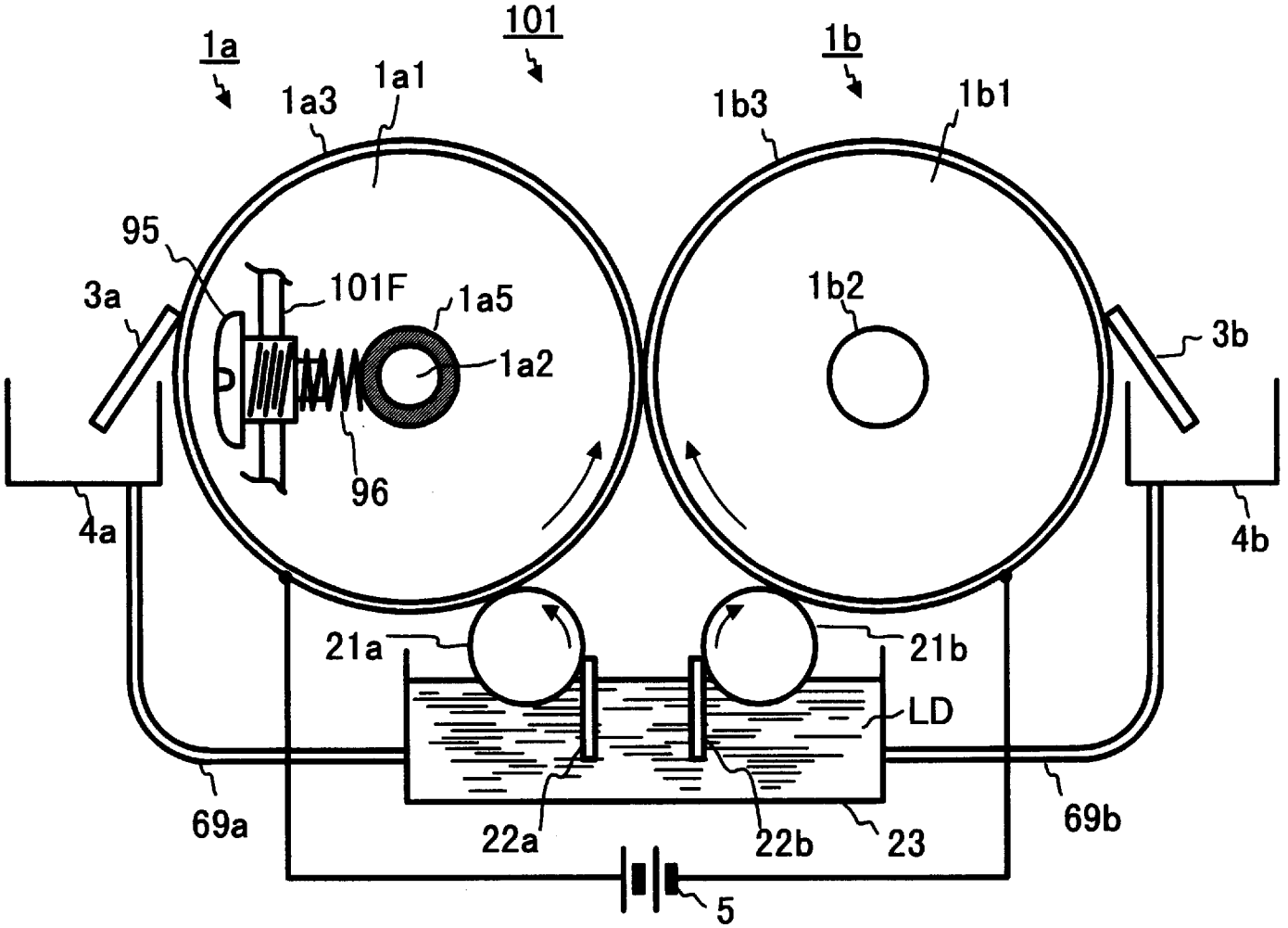
FIG. 1 is a schematic view illustrating a structure of a test apparatus for testing a liquid developer according to a first embodiment of the present invention.

Referring now to the drawings, wherein like reference numerals designate identical or corresponding parts throughout the several views.

FIG. 1 is a schematic view illustrating a structure of a test apparatus 101 for testing a liquid developer according to one embodiment of the present invention. Referring to FIG. 1, the test apparatus 101 includes a frame 101F, a first test roller 1*a*, a second test roller 1*b*, a liquid developer tank 23, a first coating roller 21*a*, a second coating roller 21*b*, a first doctor blade 3*a*, a second doctor blade 3*b*, a third doctor blade 22*a*, a fourth doctor blade 22*b*, a first recycling bucket 4*a*, a second recycling bucket 4*b*, a first recycling pipe 69*a*, a second recycling pipe 69*b*, an adjusting screw 95, a compression coil spring 96, and a direct current power source 5.

The first test roller 1*a* and the second test roller 1*b* include metal shafts 1*a*2, 1*b*2, rubber layers 1*a*1, 1*b*1, and conductive layers 1*a*3, 1*b*3, respectively. The external diameters of the first test roller 1*a* and the second test roller 1*b* may be from 10 mm to 100 mm, and preferably from 20 mm to 50 mm. The rubber layers 1*a*1 and 1*b*1 may have a hardness from 20 degrees to 60 degrees, and preferably from 20 degrees to 40 degrees, as measured by a durometer method type A provided by the Japanese Industrial Standard K 6253. In addition, the rubber layers 1*a*1 and 1*b*1 may have a thickness from a few millimeters to 50 millimeters, and preferably from 5 millimeters to 30 millimeters. The conductive layers 1*a*3 and 1*b*3 may be made of, for example, a conductive polyamide system desirably and have a volume resistivity of $10^8$ ohm·cm or less, and a thickness of 20 micrometers to 100 micrometers, and desirably from 20 micrometers to 50 micrometers. The first test roller 1*a* is supported by a journal bearing 1*a*5 at one end and by a journal bearing (not shown) at the other end.

The adjusting screw 95 is provided through the frame 101F. The compression coil spring 96 is disposed between the adjusting screw 95 and the journal bearing 1*a*5. When there is no liquid developer applied on the first test roller 1*a* or the second test roller 1*b*, the first test roller 1*a* is urged by the compression coil spring 96 and contacts the second test roller 1*b*. When the test apparatus 101 is turned on, the first test roller 1*a* is rotated in a counterclockwise direction and the second test roller 1*b* is rotated in a clockwise direction by a motor (not shown).

Figure 2:
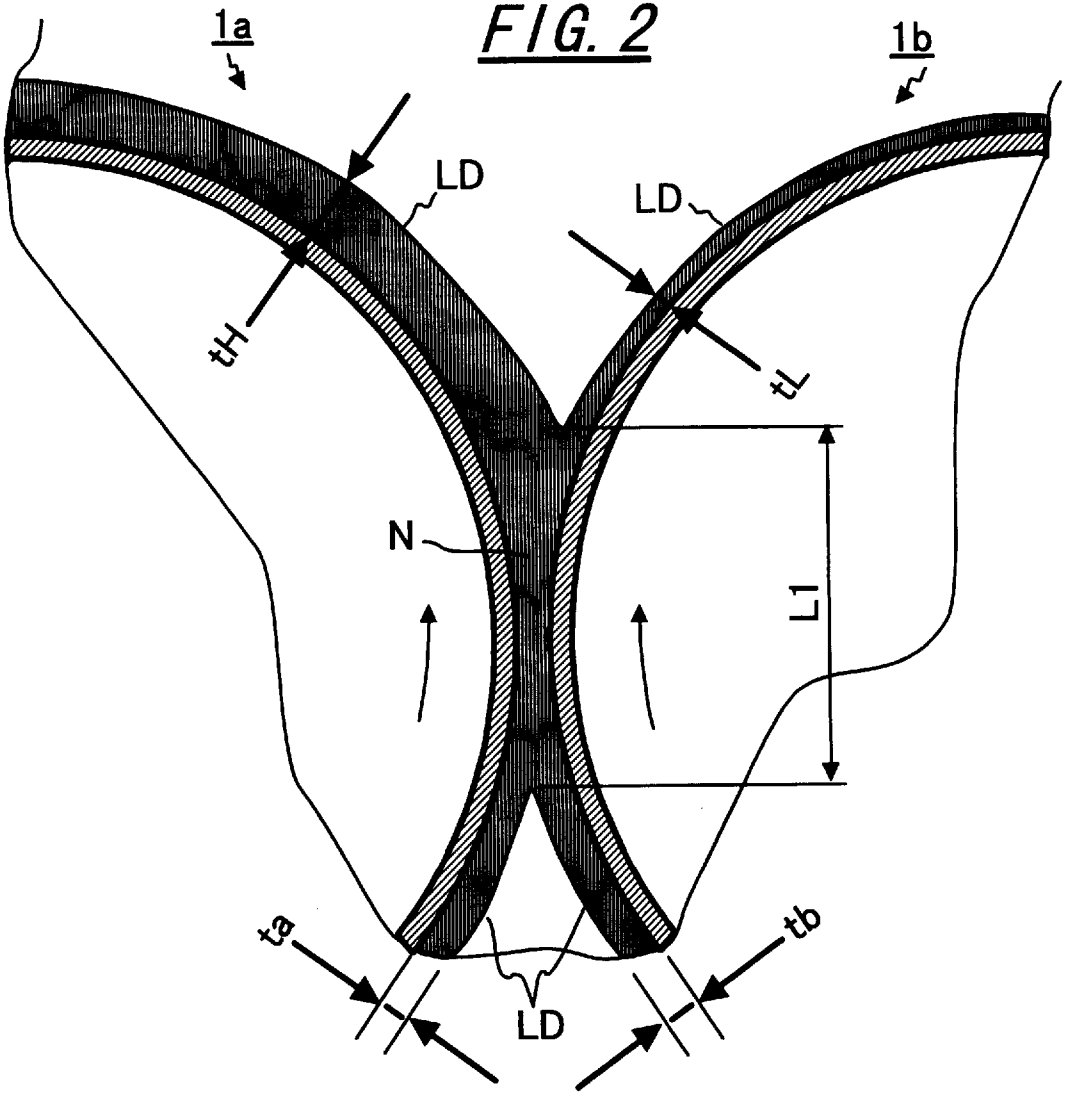
FIG. 2 is a schematic view illustrating a liquid developer adhered to rollers 1*a* and 1*b* of the test apparatus of FIG. 1 to explain differences between the rollers 1*a* and 1*b;*

FIG. 2 illustrates an area where a surface of the first test roller 1*a* comes close to a surface of the second test roller 1*b*, in which liquid developer is applied on the two rollers 1*a* and 1*b* of the test apparatus 101 of FIG. 1. Referring to FIG. 2, when a liquid developer LD is applied on the surface of the first test roller 1*a* or the second test roller 1*b*, the first test roller 1*a* is separated from the surface of the second test roller 1*b*. That is, a narrow gap N is formed where the liquid developer LD contacts both the test rollers 1*a* and 1*b*. The length of the narrow gap N is referred to as "L1" as shown in FIG. 2.

Again with reference to FIG. 1, when the adjusting screw 95 is turned clockwise, the screw 95 compresses the compression coil spring 96, and accordingly a thickness of the liquid developer LD passing through the narrow gap N decreases. When the screw 95 is turned counter clockwise, the screw 95 expands the compression coil spring 96, and accordingly the thickness of the liquid developer LD increases. The length L1 of the narrow gap N is preferably set between 1 mm and 10 mm by adjusting the adjusting screw 95. The length L1 of the narrow gap N may also be set between 1 mm and 10 mm by choosing appropriately the hardness and thickness of the rubber layers 1*a*1 and 1*b*1 of the test rollers 1*a* and 1*b*. When the rubber layer 1*a*1 or 1*b*1 is softened or thickened, the length L1 of the narrow gap N increases, and when the rubber layer 1*a*1 or 1*b*1 is hardened or thinned the length L1 of the narrow gap N decreases.

The liquid developer tank 23 contains liquid developer LD. The first coating roller 21*a* and the second coating roller 21*b* respectively contact the first test roller 1*a* and the second test roller 1*b*. In addition, lower parts of the rollers 21*a* and 21*b* are dipped in the liquid developer LD. The coating rollers 21*a* and 21*b* have multiple small hollows for carrying the liquid developer LD. The rollers structured as such are often referred to as gravure rollers. When the test apparatus 101 is turned on, the first coating roller 21*a* rotates in a counterclockwise direction and the second coating roller 21*b* rotates in a clockwise direction. During the operation of the test apparatus 101, the multiple small hollows of the coating rollers 21*a* and 21*b* scoop the liquid developer LD in the liquid developer tank 23 and carry the developer so as to apply the developer LD onto the test rollers 1*a* and 1*b*. Consequently, liquid developer layers having predetermined thicknesses (shown as "ta" and "tb" in FIG. 2) are formed on surfaces of the first test roller 1*a* and the second test roller 1*b*.

Excessive liquid developer LD carried in the hollows or on the surfaces of the coating rollers 21*a* and 21*b* is respectively scraped off by the third doctor blade 22*a* and the fourth doctor blade 22*b*. The scraped liquid developer LD returns to the liquid developer tank 23.

Referring to FIG. 2, the combined thickness of the liquid developer LD on the first and second test rollers 1*a* and 1*b* (i.e., a sum of the thicknesses "ta" and "tb"), which are both coated upstream of the narrow gap N corresponding to rotating directions of the test rollers 1*a* and 1*b*, is preferably between 3 micrometers and 15 micrometers. Thus, the liquid developer LD smoothly passes through the narrow gap N without stagnating. Accordingly, when the liquid developer layer is formed on both the first test roller 1*a* and the second test roller 1*b*, the thicknesses "ta" and "tb" are preferably set between 1.5 micrometers and 7.5 micrometers. When the liquid developer layer is formed on only one of the first test roller 1*a* or the second test roller 1*b*, the thickness "ta" or "tb" is preferably set between 3 micrometers and 15 micrometers. The thicknesses "ta" and "tb" on the test rollers 1*a* and 1*b* are affected by the size of each hollow and the density of the hollows (i.e., the number of the hollows per a unit area). The thicknesses "ta" and "tb" of the liquid developer LD increase as either the size or the density of the hollows increases.

In addition, when the liquid developer is left without being agitated, a viscosity of liquid developer changes. In addition, the viscosity of the liquid developer left unused is apt to be higher than that of liquid developer in use. The change of viscosity is often caused by cohesion of toner particles (imaging particles) in the liquid developer. When the liquid developer is agitated, the toner particles are dispersed in the liquid developer, similar to that in an actual image forming apparatus.

The direct current power source 5 applies different electric potentials to the first test roller 1*a* and the second test roller 1*b*. Thereby, a difference of electric potentials between surfaces of the rollers 1*a*, 1*b* is generated. The difference of electric potentials between the surfaces of the rollers 1*a*, 1*b* is preferably set such that an electric field strength at the narrow gap N is between 2 Volts/micrometer and 500 Volts/micrometer. When the thickness of the liquid developer LD at the narrow gap N is, for example, 10 micrometers, then the difference of the electric potentials between the surfaces of the rollers 1*a*, 1*b* must be 300 volts to achieve an electric field strength of 30 Volts/micrometer at the narrow gap N. The difference of the electric potentials described above is similar to a difference of electric potentials between an image carrier and a developing device in an actual image forming apparatus using the narrow gap developing method.

Further, the liquid developer LD adhered to the first test roller 1*a* and the second test roller 1*b* is scraped off by the first doctor blade 3*a* and the second doctor blade 3*b* at a position downstream of the narrow gap N in the rotating directions of the rollers 1*a* and 1*b*. The scraped liquid developer LD returns to the liquid developer tank 23 via the first recycling bucket 4*a* and the first recycling pipe 69*a*, and via the second recycling bucket 4*b* and the second recycling pipe 69*b*.

Referring again to FIG. 2, when the liquid developer LD passes through the narrow gap N under a certain electric field strength, toner particles in the liquid developer LD are attracted by one of the test rollers 1*a* and 1*b* and are repelled by the other test roller. Negatively charged toner particles charged are attracted to the test roller 1*a* or 1*b* with a higher electric potential, and positively charged toner particles charged are attracted to the other test roller with a lower electric potential. In general, most toner particles in the liquid developer include positively charged particles and negatively charged particles.

In addition, the thicknesses of the liquid developer LD adhered to the first test roller 1*a* and the second test roller 1*b* are different. The difference depends on the liquid developer and the polarity of the direct current power source 5. In this embodiment, "tH" denotes a thickness of the liquid developer LD adhered to one of the test rollers 1*a* and 1*b*, which attracts toner particles in the developer more than the other test roller. "tL" denotes a thickness of the liquid developer LD adhered to the other test roller. A test roller having a higher electric potential than the other test roller attracts negatively charged toner particles and repels positively charged toner particles. Likewise, the other test roller (i.e., the test roller having a lower electric potential) attracts positively charged toner particles and repels negatively charged toner particles.

Further, "WH" denotes a weight per unit area of the liquid developer LD adhered to one of the test rollers 1*a* and 1*b*, which attracts toner particles in the liquid developer LD more than the other test roller. "WL" denotes a weight per unit area of the liquid developer LD adhered to the other test roller. The weight per unit area is approximately proportional to the thickness of the liquid developer LD adhered to the test rollers.

Figure 3B:
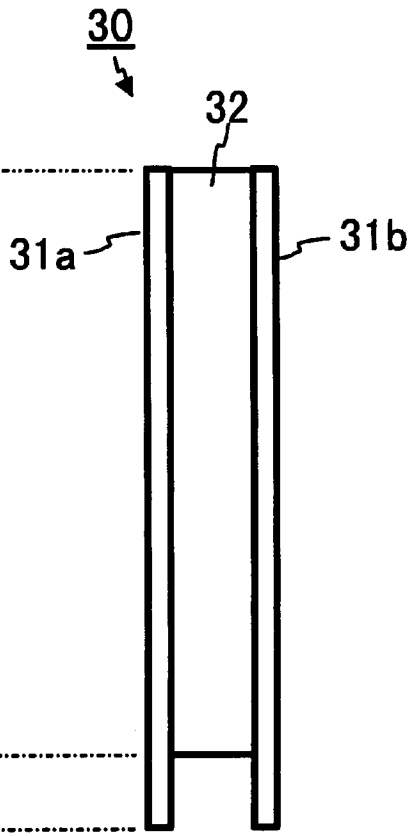
FIGS. 3A and 3B are a front view and a side view, respectively, illustrating a structure of a tool for measuring a thickness of a liquid developer adhered to a surface of a roller.
Figure 3A:
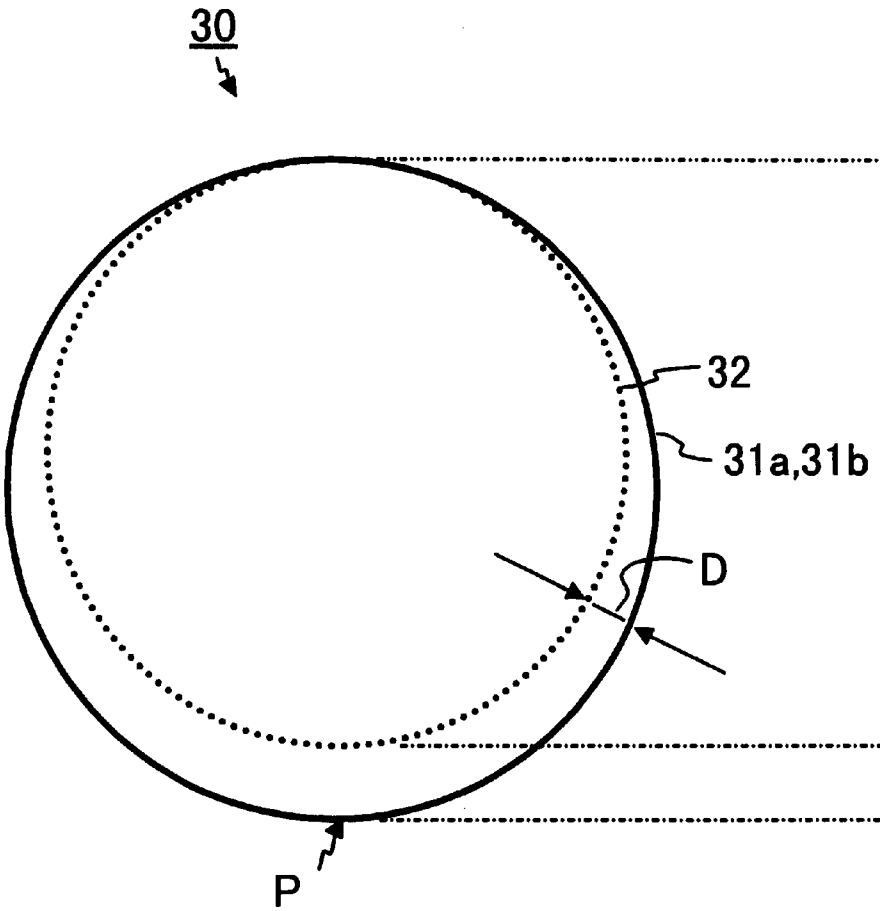

The thicknesses "tH" and "tL" of the liquid developer LD adhered to the test rollers 1*a* and 1*b* may be measured by, for example, a measuring tool 30 shown in FIGS. 3A and 3B, which is known as a "WET THICKNESS GAUGE ERICHSEN Type 234." The measuring tool 30 includes two concentric disks 31*a* and 31*b*, and a disk 32 smaller in diameter than the disks 31*a* and 31*b*. The disk 32 is sandwiched by the disks 31*a* and 31*b* and is eccentric relative to the disks 31*a* and 31*b*. Thereby, a difference "D" in level between the disk 32 and the disks 31*a* and 31*b* varies depending upon an angular position of the tool 30.

Figure 4:
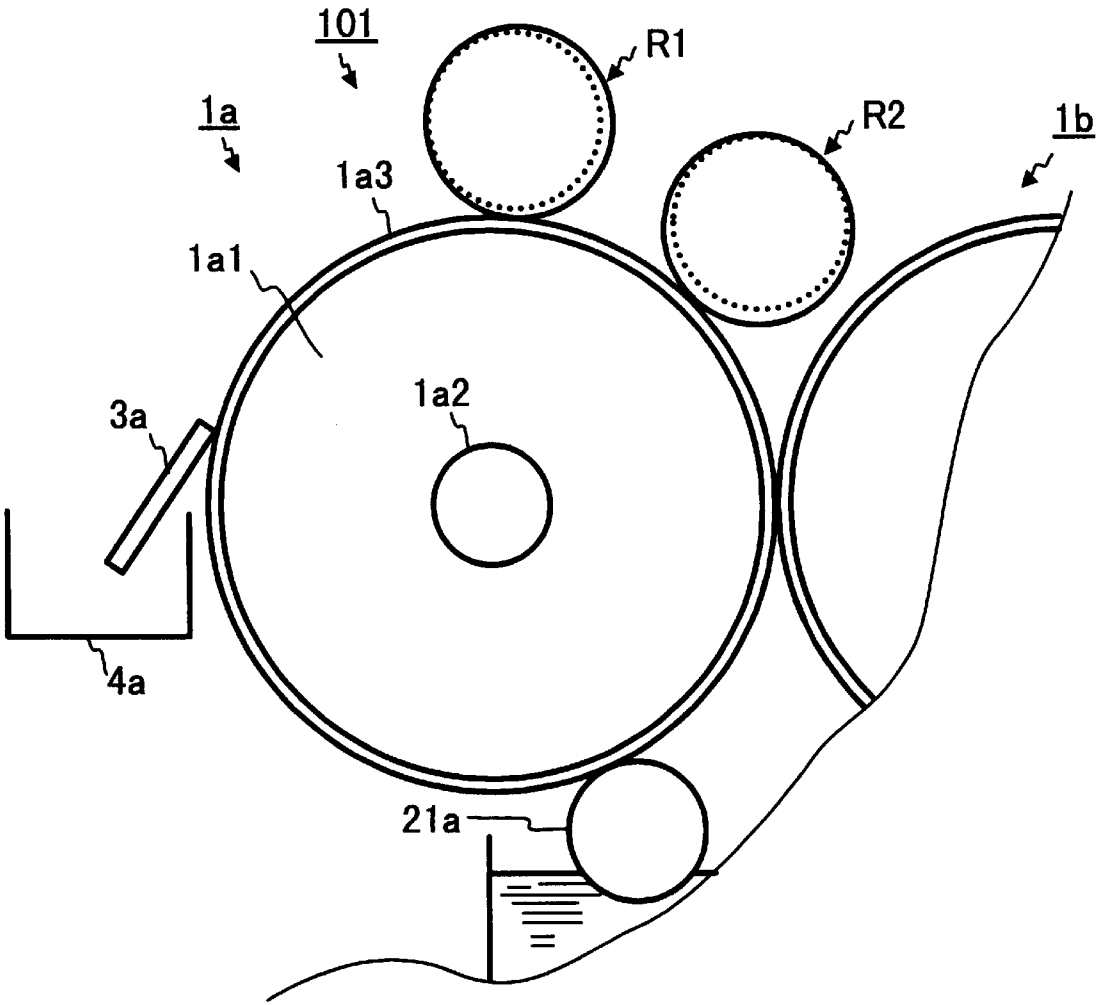
FIG. 4 is a schematic view illustrating the tool of FIGS. 3A and 3B used in the test apparatus of FIG. 1.

Referring to FIG. 4, after the test apparatus 101 halts, the measuring tool 30 at a position "P" in FIG. 3A (where the difference "D" is the greatest), is first placed on the test roller 1*a* as indicated by "R1" in FIG. 4. The measuring tool 30 is then rolled toward a position indicated by "R2." When the tool 30 is rolled to the position R2 and the thickness of the liquid developer LD on the first test roller 1*a* coincides with the depth "D" of a groove formed by the difference in level, the liquid developer LD on the test roller 1*a* transfers to the groove.

Figures 5A, 5B:
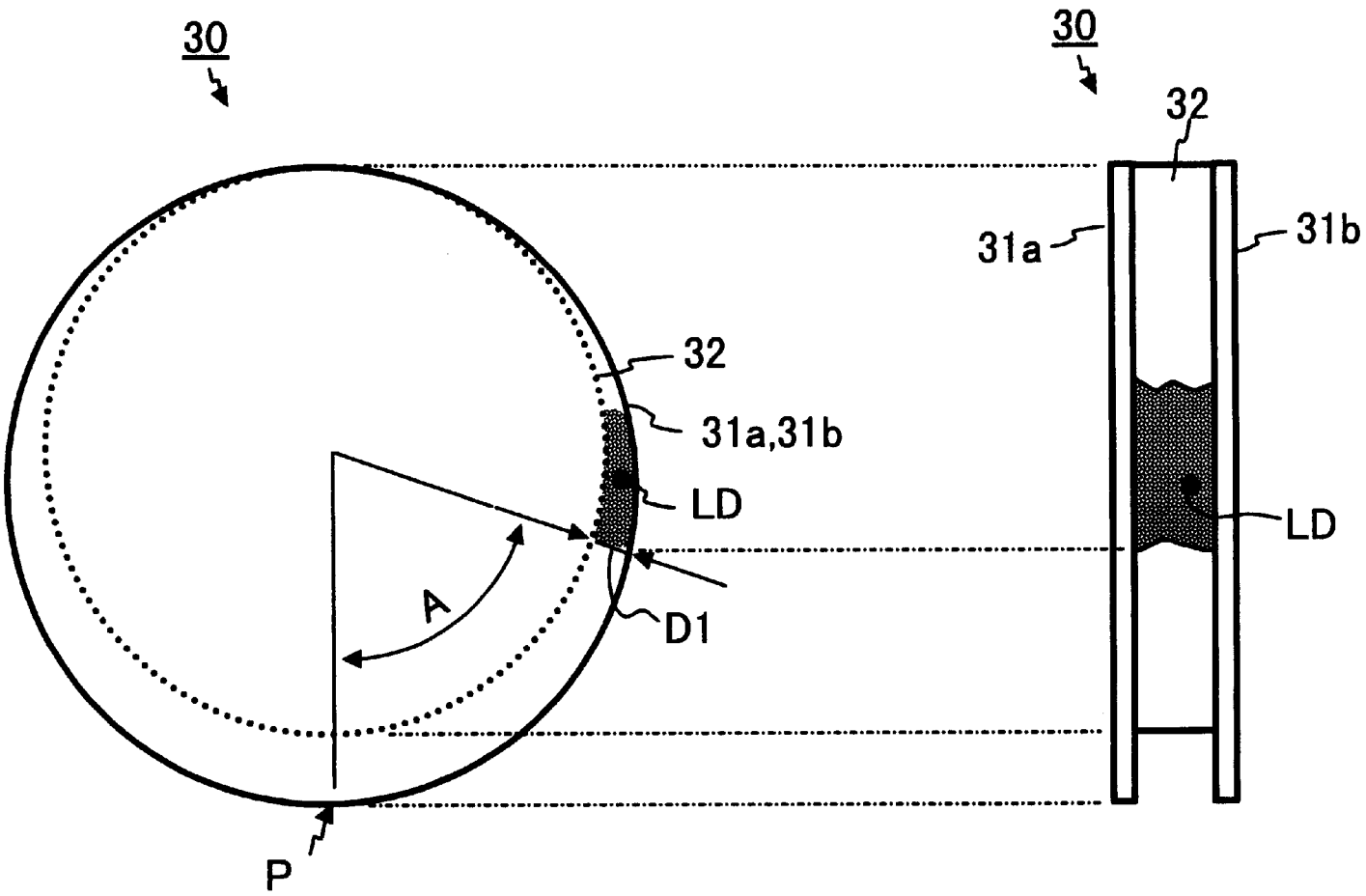
FIGS. 5A and 5B are a front view and a side view, respectively, illustrating the liquid developer transferred from the roller 1*a* of FIG. 1 to the tool of FIGS. 3A and 3B.

FIGS. 5A and 5B illustrate that the liquid developer LD is transferred to the groove at the position having the depth "D1," which is at the angle "A" relative to the position P. The depth "D1" of the groove (i.e., the thickness "D1" of the liquid developer LD transferred from the test roller 1*a*) is measured by converting the angle "A," as shown in FIGS. 5A and 5B. A scale indicating a depth of the groove may be inscribed on the surface of the disk 31*a* or 31*b*.

The thicknesses "tH" and "tL" may also be measured with a non-contact measuring apparatus, such as one sold under the trademark LASER SCAN MICROMETER, which is produced by MITSUTOYO company. When such a non-contact measuring apparatus is used, the distance from the measuring apparatus to the surface of the liquid developer LD adhered to the test roller 1*a* is first measured, and then the liquid developer LD is removed from the surface of the first test roller 1*a*. Then, the distance from the measuring apparatus to the surface of the test roller 1*a* is again measured, and the thickness of the liquid developer LD is obtained as a difference between the first measured value and the second measured value. The thickness of the liquid developer LD on the second test roller 1*b* may be measured in the same way.

The weights "WH" and "WL" of the liquid developer on the test rollers 1*a* and 1*b* may be determined, for example, by using a conversion table, which is preliminary provided based on an experiment.

The inventors of the present invention have found that a ratio "tL/tH" between the thicknesses of the liquid developer on the test rollers 1*a* and 1*b* varies depending upon the characteristic of liquid developer. In addition, the inventors have found that a liquid developer having a ratio "tL/tH" smaller than 0.71 achieves a good image quality with a decreased background soiling and an increased image density with the narrow gap developing method.

Figure 6A:
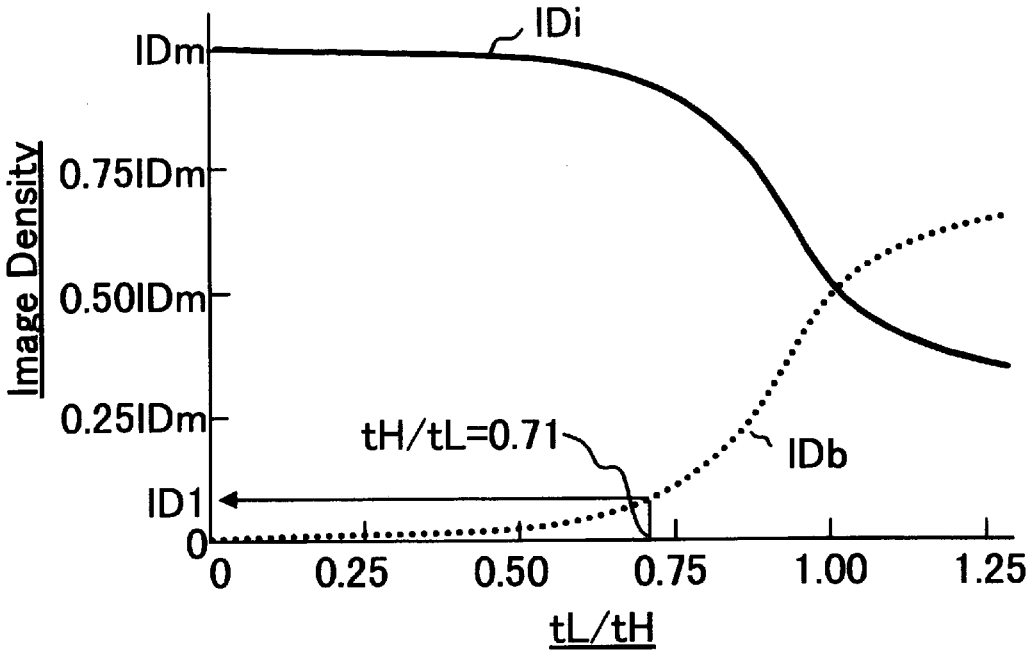
FIG. 6A is a graph illustrating a relationship between a ratio of thicknesses of a liquid developer adhered to the rollers 1*a* and 1*b* of FIG. 1 and an image density when the liquid developer forms an image.

FIG. 6A is a graph illustrating a relationship between a ratio "tL/tH" (i.e., the ratio of the thicknesses of liquid developer adhered to the rollers 1*a* and 1*b* of FIG. 1), and an image density of an image formed by an image forming apparatus with the same liquid developer using the narrow gap developing method. In FIG. 6A, the horizontal axis represents the ratio "tL/tH" for various types of liquid developer. A specific value of the ratio "tL/tH" corresponds to a specific liquid developer. The vertical axis represents "image density." In the vertical axis, "IDm" denotes the maximum image density, for example, 1.5, and "ID1" denotes an allowable image density of background soil, for example, 0.03. The curve "IDi" illustrates a relationship between the ratio "tL/tH" and "image density" of an image portion and the curve "IDb" illustrates a relationship between the ratio "tL/tH" and "image density" of a non-image portion (i.e., a background portion).

According to FIG. 6A, when the ratio "tL/tH" is equal to or greater than zero and smaller than 0.71, the image density of the non-image portion (i.e., the background portion), is smaller than the allowable image density "ID1" of background soil. Further, the image density of the image portion is close to the maximum image density "IDm."

Figure 6B:
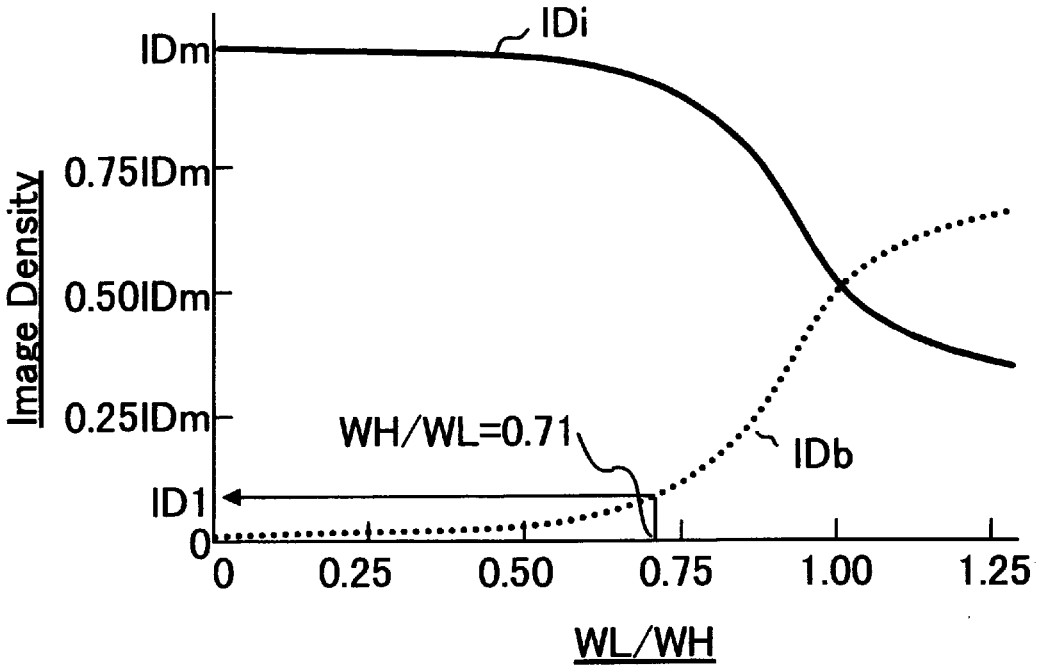
FIG. 6B is a graph illustrating a relationship between a ratio of weights per unit area of a liquid developer adhered to the rollers 1*a* and 1*b* of FIG. 1 and an image density when the liquid developer forms an image.

FIG. 6B is a graph illustrating a relationship between a ratio "WL/WH" (i.e., the ratio of the weight per unit area of the liquid developer adhered to the rollers 1*a* and 1*b* of FIG. 1), and an image density of an image formed by the image forming apparatus with the same liquid developer using the narrow gap developing method. In FIG. 6B, the horizontal axis represents a ratio "WL/WH" between the weights per unit area of the liquid developer LD on the first test roller 1*a* and the second test roller 1*b*. A specific value of the ratio "WL/WH" corresponds to a specific liquid developer. The vertical axis represents "image density" as in FIG. 6A. Likewise, the curve "IDi" and the curve "IDb" respectively illustrate relationships between the ratio "WL/WH" and "image density" of an image portion and that of a non-image portion (i.e., a background portion).

According to FIG. 6B, when a liquid developer having the ratio "WL/WH" equal to or greater than zero and smaller than 0.71 is used in an image forming apparatus, the image density of the non-image portion (i.e., the background portion) is smaller than the allowable image density "ID1" of background soil. The liquid developer LD also keeps the image density high at the image portion. Accordingly, an image forming apparatus using such a liquid developer produces a quality image without using a dielectric release liquid or pre-wetting liquid.

In the above embodiment, one or both of the first test roller 1*a* and the second test roller 1*b* may be formed with a solid metal structure. The surface of the rollers may be coated with material having a high volume resistivity of, for example, $10^{12}$ ohm·cm or more and a thickness of between 20 micrometers and 500 micrometers.

Figure 7:
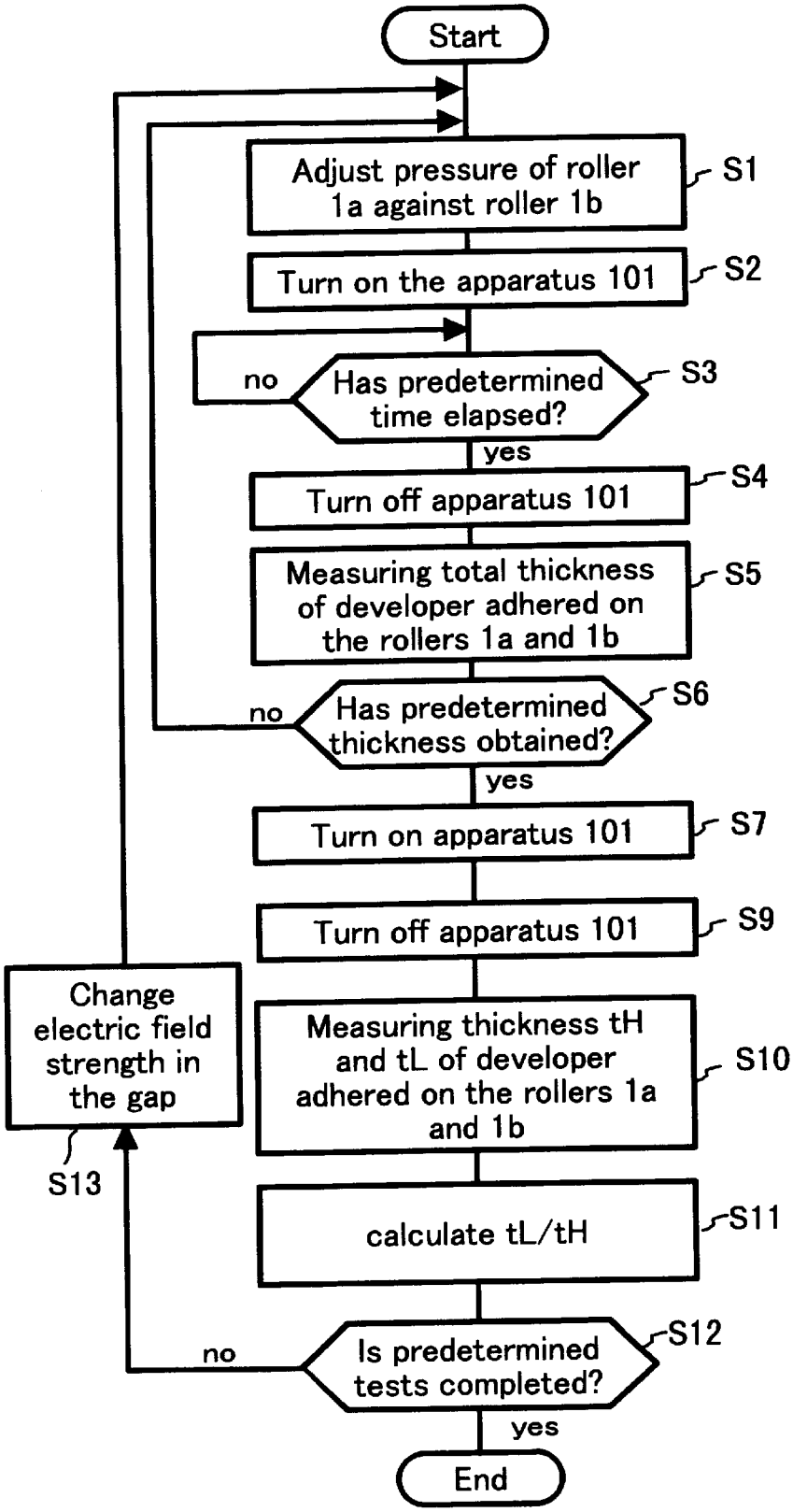
FIG. 7 is a flowchart illustrating operational steps for measuring a thickness of a liquid developer adhered to the rollers 1*a* and 1*b* of FIG. 1.

FIG. 7 is one example of a flowchart illustrating operational steps for measuring the thickness of the liquid developer adhered to the rollers 1*a* and 1*b* of FIG. 1. In step S1, a pressure of the first test roller 1*a* against the second test roller 1*b* is set by turning the adjusting screw 95 according to a conversion table between pressures and a width of the narrow gap N, which was prepared based on an experiment. In step S2, the test apparatus 101 is turned on, and the first test roller 1*a*, the second test roller 1*b*, the first coating roller 21*a*, and the second coating roller 21*b* start rotation.

Figure 8:
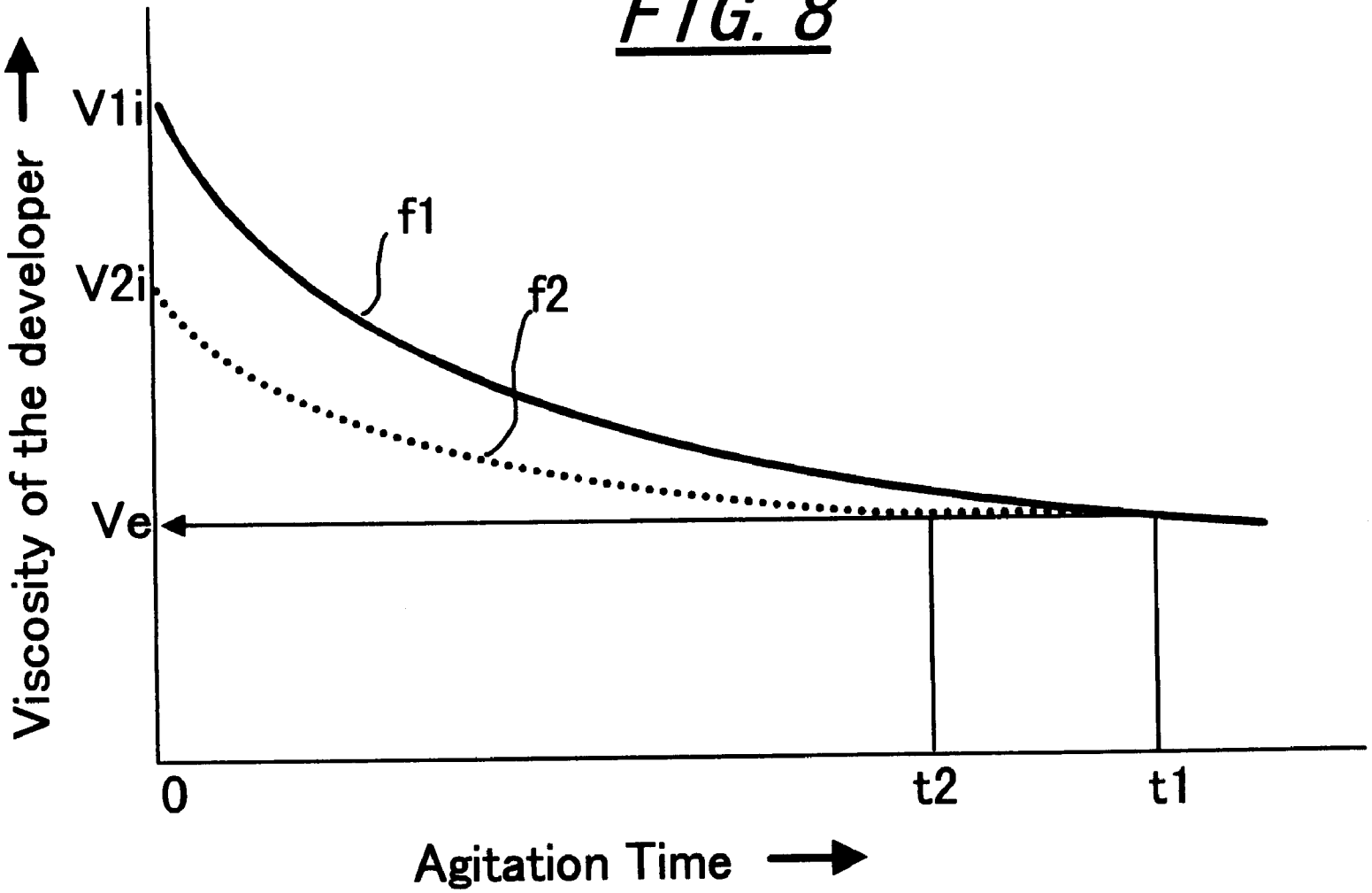
FIG. 8 is a graph illustrating a relationship between an agitation time and a viscosity of a liquid developer.

In step S3, a timer runs until a predetermined time expires so that the test apparatus 101 is operating for the predetermined time. That is, referring to FIG. 8, the curves f1 and f2 indicate relationships between the viscosity of the liquid developer LD and an agitation time. "V1*i*" indicates an initial viscosity of the liquid developer LD left unused for a long time, and t1 indicates a time when the viscosity of the liquid developer LD becomes constant, which is close to that of the liquid developer used in an actual image forming apparatus. "V2*i*" indicates an initial viscosity of the liquid developer LD left unused for a relatively short time, for example, one hour, and t2 indicates a time when the viscosity of the liquid developer LD becomes substantially constant. Thereby, the predetermined time of the timer may be set to t1 so that the liquid developer LD is circulated in the liquid developer tank 23 via the coating rollers 21*a* and 21*b*, the test rollers 1*a* and1*b*, the recycling buckets 4*a* and 4*b*, and the recycling pipe 69*a* and 69*b*. Thus, the liquid developer LD is agitated. Further, testing the liquid developer under such a viscosity condition also achieves an accurate measuring result.

Referring again to FIG. 7, in step S4, the test apparatus 101 is turned off. In step S5, the thickness "ta" of the liquid developer LD adhered to the first test roller 1*a* and the thickness "tb" of the liquid developer LD adhered to the second test roller 1*b* are measured, and a total thickness "ta+tb" is obtained by summing the thickness "ta" and "tb." In step S6, it is judged whether the total thickness "ta+tb" measured in the step S5 is in the predetermined range of 3 micrometers to 15 micrometers. When the total thickness "ta+tb" is in the predetermined range, the process proceeds to step S7. When the total thickness is out of the predetermined range, the process returns to the step S1 to readjust the pressure of the first test roller 1*a* against the second test roller 1*b*.

In step S7, the test apparatus 101 is again turned on. In step S9, the test apparatus 101 is again turned off. In the step S10, the thickness "tH" of the liquid developer LD adhered to one of the two test rollers 1*a* and 1*b* and the thickness "tL" of the liquid developer LD adhered to the other test roller are measured.

In step S11, a ratio "tL/tH" is calculated. When the ratio "tL/tH" is equal to or greater than zero and smaller than 0.71, the liquid developer LD tested in the above processes is determined as being sufficient to form an image with a decreased background soiling and an increased image density without using a dielectric release liquid or pre-wetting liquid.

In step S12, when an additional test remains, for example, a test with a different electric field strength in the narrow gap N, the process proceeds to step S13. In step S13, the electric field strength in the narrow gap N is changed from that in the previous test and the process returns to the step S1. In step S13, other test conditions, such as, the total thickness ta+tb, the circumferential velocity of the first test roller 1*a*, the circumferential velocity of the second test roller 1*a*, and so fourth can be changed as necessary.

Figure 9:
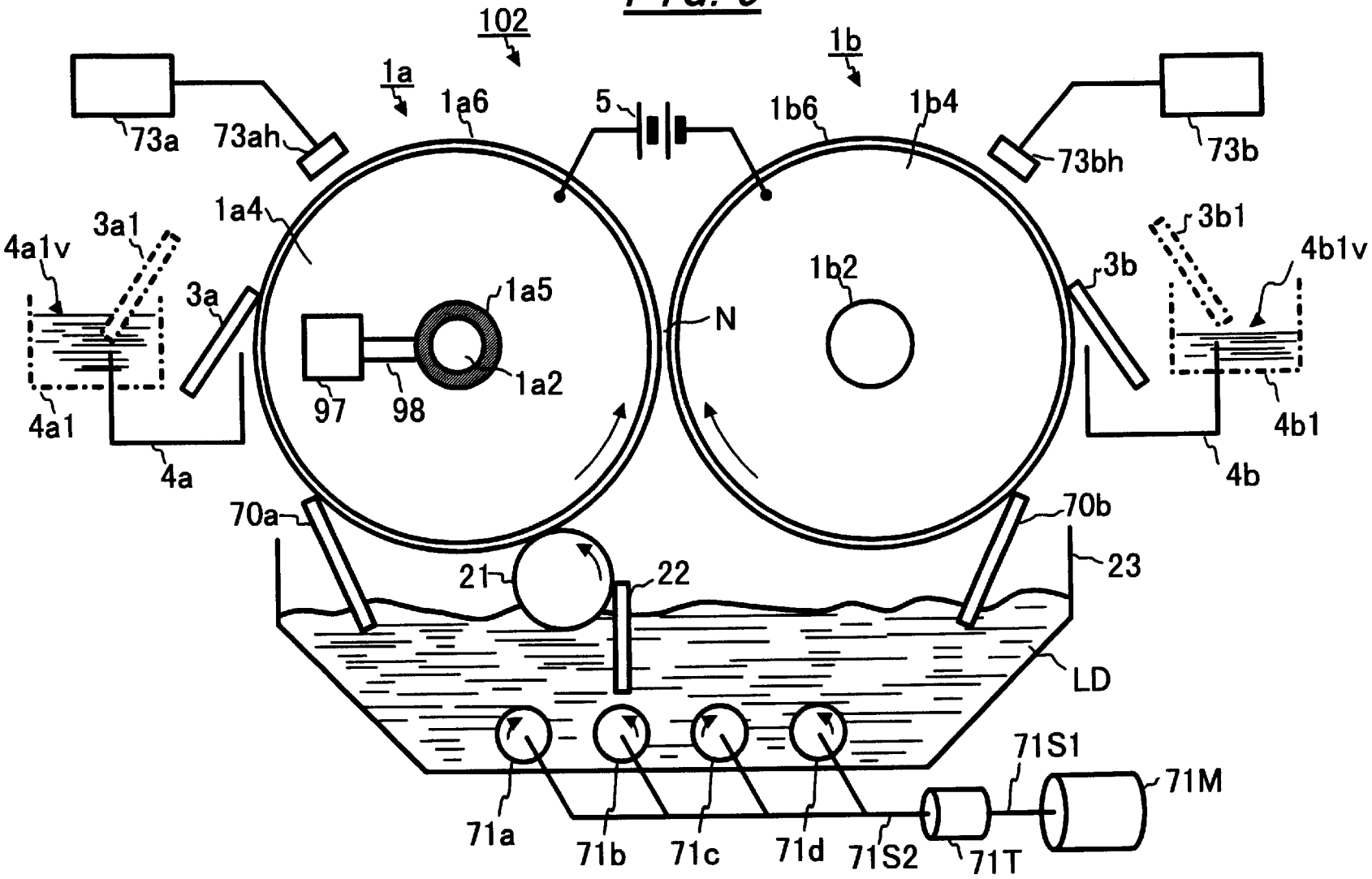
FIG. 9 is a schematic view illustrating a structure of a test apparatus according to another embodiment of the present invention.

FIG. 9 is a schematic view illustrating a structure of a test apparatus 102 according to a second embodiment of the present invention. In FIG. 9, the elements that are substantially the same as those in FIG. 1 are denoted by the same reference numerals. Referring to FIG. 9, the test apparatus 102 includes a frame 102F, a first test roller 1*a*, a second test roller 1*b*, a liquid developer tank 23, a coating roller 21, a first doctor blade 3*a*, a second doctor blade 3*b*, a third doctor blade 22, a fourth doctor blade 70*a*, a fifth doctor blade 70*b*, a first recycling bucket 4*a*, a second recycling bucket 4*b*, agitating bladed-wheels 71*a*, 71*b*, 71*c*, and 71*d*, an agitating motor 71M having a shaft 71S1, a torque meter 71T, a driving mechanism 71S2, a narrow gap control motor 97, and a narrow gap control mechanism 98.

The first test roller 1*a* and the second test roller 1*b* may be made of metal and include metal shafts 1*a*2 and 1*b*2, bodies 1*a*4 and 1*b*4, and insulating layers 1*a*6 and 1*b*6, respectively. The external diameters of the test rollers 1*a*, 1*b* may be between 10 mm and 100 mm, and desirably be between 20 mm and 50 mm. The insulating layers 1*a*6 and 1*b*6 may made of, for example, an ethylene fluoride system and preferably have a volume resistivity of $10^{12}$ ohm·cm or more. The first test roller 1*a* is supported by a journal bearing 1*a*5 at one end and by a journal bearing (not shown) at the other end.

When the apparatus 102 is turned on, the first test roller 1*a* rotates in a counterclockwise direction and the second test roller 1*b* rotates in a clockwise direction by a motor (not shown). The narrow gap control mechanism 98 is disposed between the narrow gap control motor 97 and the journal bearing 1*a*5. When the narrow gap control motor 97 rotates in a clockwise direction, the narrow gap control mechanism 98 urges the first test roller 1*a* to move rightward so as to decrease the narrow gap N between the test rollers 1*a* and 1*b*. When the narrow gap control motor 97 rotates in a counterclockwise direction, the narrow gap control mechanism 98 urges the first test roller 1*a* to move leftward so as to increase the narrow gap N.

Figure 10:
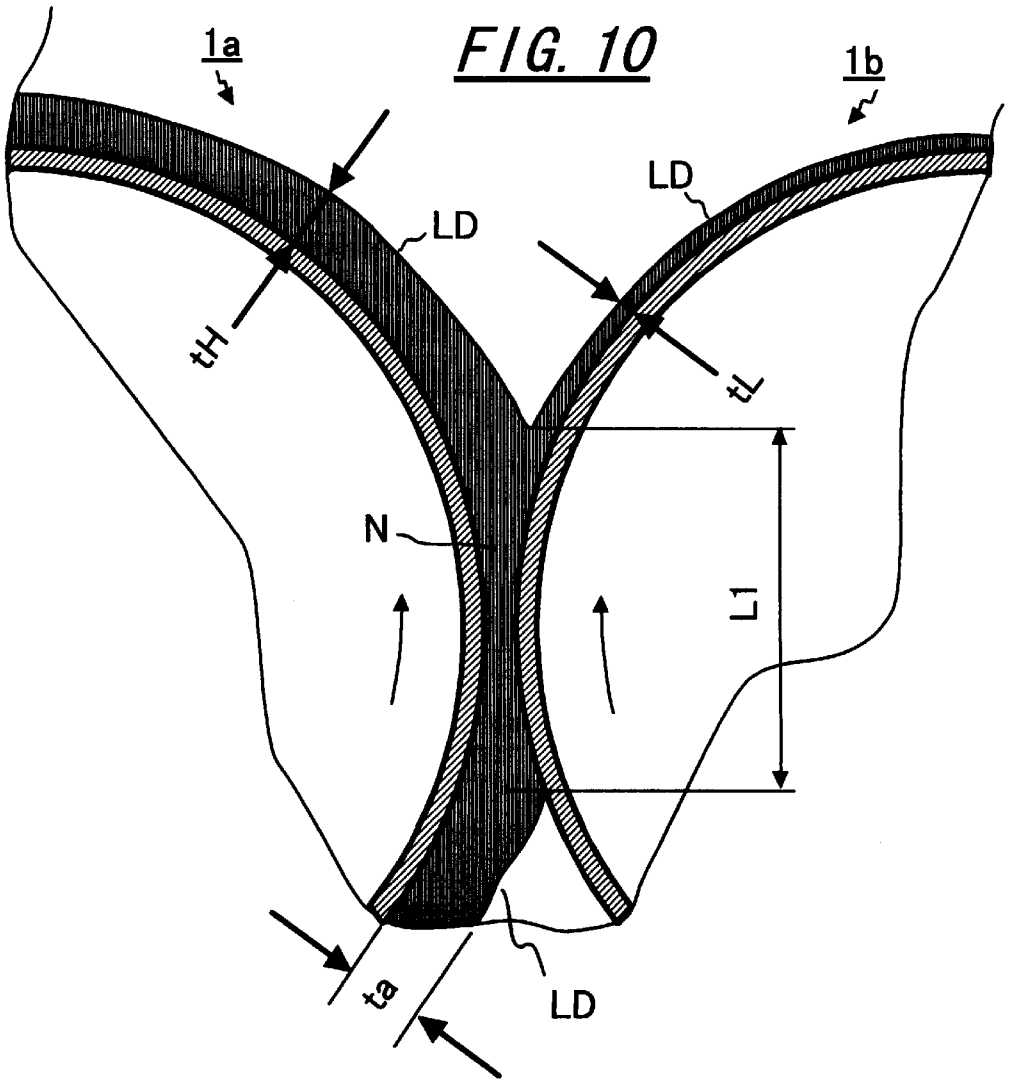
FIG. 10 is a schematic view illustrating a thickness of a liquid developer adhered to rollers 1*a* and 1*b* of the test apparatus of FIG. 9.

FIG. 10 illustrates an area where a surface of the first test roller 1*a* comes close to a surface of the second test roller 1*b* when the liquid developer is adhered on the two rollers 1*a* and 1*b* of the test apparatus 102 of FIG. 9. The elements "N," "L1," "ta," "tH," "tL" in FIG. 10 denote the same as those in FIG. 2. As FIG. 10 illustrates, in this embodiment, the liquid developer LD is applied on the first test roller 1*a* with the thickness "ta" upstream to the narrow gap N in the rotating directions of the first and second test rollers 1*a*, 1*b*.

Referring again to FIG. 9, the liquid developer tank 23 contains liquid developer LD. The coating roller 21 contacts the first test roller 1*a* and the lower part of the roller 21 is dipped in the liquid developer LD. The coating roller 21 has multiple small hollows for carrying the liquid developer LD. When the test apparatus 102 is turned on, the coating roller 21 rotates in a counterclockwise direction, and the multiple small hollows scoop the liquid developer LD at a low position in the liquid developer tank 23, and then carry and apply the liquid developer LD onto the first test roller 1*a*.

Excessive liquid developer LD carried in the hollows or on the surface of the coating roller 21 is scraped off by the third doctor blade 22 and returned to the liquid developer tank 23. The thickness of the liquid developer LD on the first test roller 1*a* (i.e., "ta" as shown in FIG. 10 upstream to the narrow gap N in the rotating direction of the first test roller 1*a*), may preferably be between 3 micrometers and 15 micrometers, such that the liquid developer LD smoothly passes through the narrow gap N without stagnating.

The agitating bladed-wheels 71*a*, 71*b*, 71*c*, and 71*d* are driven by the agitating motor 71M via the shaft 71S1 of the motor 71M, the torque meter 71T, and the driving mechanism 71S12. The agitating bladed-wheels 71*a*, 71*b*, 71*c*, and 71*d* agitate the liquid developer LD in the liquid developer tank 23. As described above, the viscosity of the liquid developer LD changes when the liquid developer LD is left unused. Accordingly, a torque to agitate the liquid developer LD by the above-described agitating system may be changed according to the viscosity for the liquid developer LD. In general, the agitation torque of the liquid developer left unused is apt to be greater than that of liquid developer in use.

In addition, the direct current power source 5 applies different electric potentials to the first test roller 1*a* and the second test roller 1*b*, thereby a difference of the electric potentials between the surfaces of the rollers 1*a*, 1*b* is generated. In FIG. 9, reference numerals 73*a* and 73*b* denote surface potential meters, and reference numerals 73*ah* and 73*bh* denote measuring heads of the surface potential meters 73*a* and 73*b* for respectively measuring the surfaces potentials of the test rollers 1*a* and 1*b*. The difference of electric potentials between the surfaces of the test rollers 1*a* and 1*b* is preferably adjusted such that an electric field strength at the narrow gap N is in the range of 2 to 500 Volts/micrometer.

The first doctor blade 3*a* and the second doctor blade 3*b* respectively remove the liquid developer LD adhered to the first test roller 1*a* and the second test roller 1*b*, and the removed liquid developer is accumulated in the recycling buckets 4*a* and 4*b*. A first pair including the first doctor blade 3*a* and the first recycling bucket 4*a* and a second pair including the second doctor blade 3*b* and the second recycling bucket 4*b* are detachable from the test apparatus 102 so as to measure the weight of the liquid developer LD in the buckets 4*a* and 4*b*. When the pairs are removed, the fourth doctor blade 70*a* and the fifth doctor blade 70*b* remove the liquid developer LD adhered to the test rollers 1*a* and 1*b*, and the removed liquid developer directly returns to the liquid developer tank 23.

Referring again to FIG. 10, when the liquid developer LD passes through the narrow gap N having a predetermined electric field strength, a specific amount of the liquid developer LD adhering to the first test roller 1*a* upstream of the narrow gap N, is adhered to one of the test rollers 1*a* and 1*b* and the remaining amount of the liquid developer LD is adhered to the other test roller in substantially the same manner as in the test apparatus 101 of the first embodiment described before. Therefore, when the liquid developer being tested by the test apparatus 102 has the ratio "tL/tH" or the ratio "WL/WH," which is smaller than 0.71, an image forming apparatus using the liquid developer and the narrow gap developing method achieves a good image quality with a decreased background soiling and a high image density.

Figure 11:
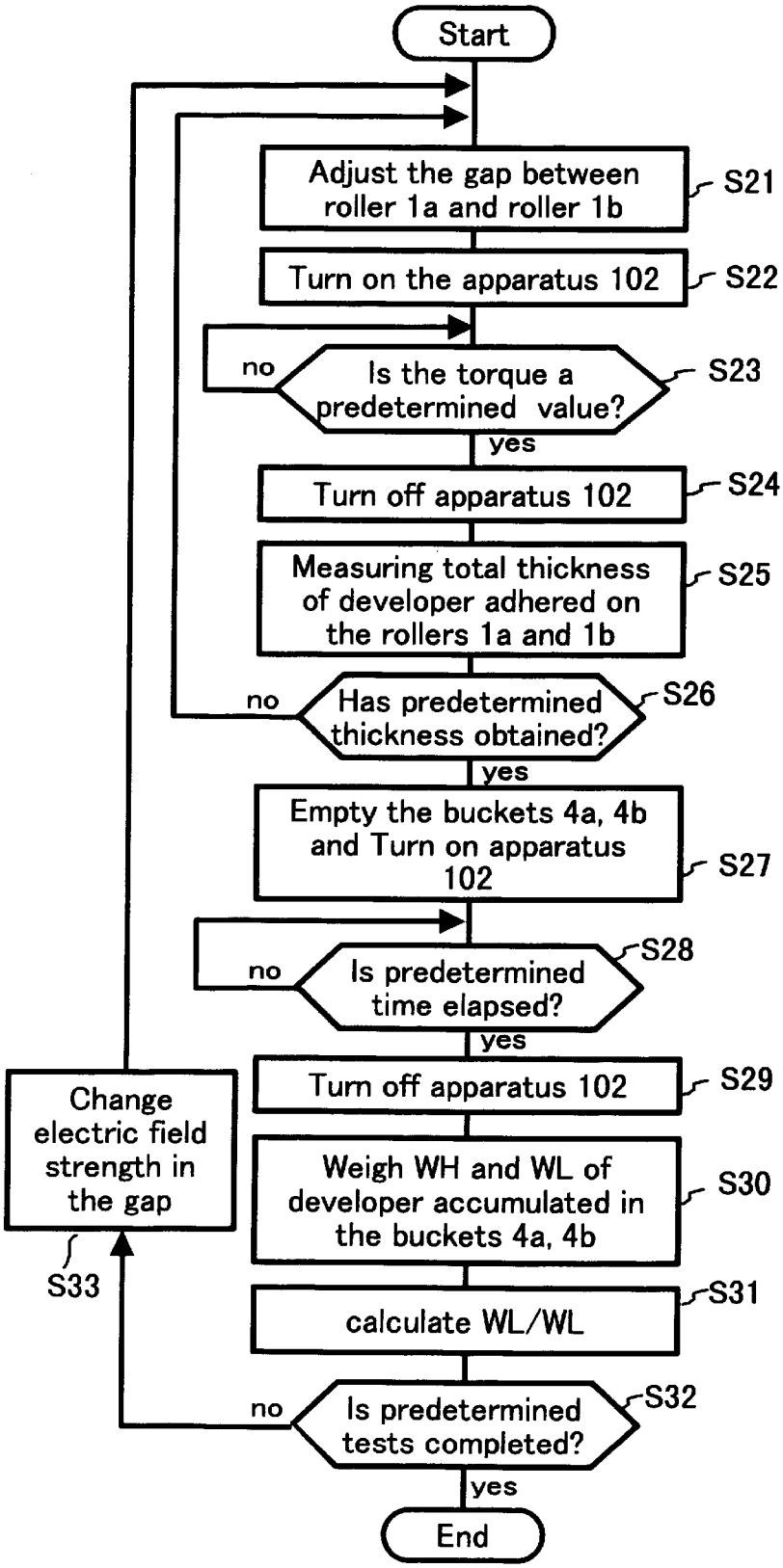
FIG. 11 is a flowchart illustrating operational steps for measuring a weight per unit area of a liquid developer adhered to the rollers 1*a* and 1*b* of FIG. 9.

FIG. 11 is a flowchart illustrating operational steps for measuring the thickness of the liquid developer LD adhered to test rollers 1*a* and 1*b* of FIG. 9. In step S21, the gap between the first test roller 1*a* and the second test roller 1*b* is set to a predetermined width. In step S22, the test apparatus 102 is turned on, and the first test roller 1*a*, the second test roller 1*b*, the coating roller 21, and the agitating motor 71M start rotating.

In step S23, the test apparatus 102 keeps operating until the torque measured by the torque meter 71T shows a predetermined value, which is close to that used in an actual image forming apparatus.

In step S24, the test apparatus 102 is turned off. In step S25, the thickness "ta" of the liquid developer LD adhered to the first test roller 1*a* is measured. In step S26, it is determined whether the thickness "ta" measured in the step S25 is in the predetermined range of 3 to 15 micrometers. When the thickness "ta" is in the predetermined range, the process proceeds to step S27. When the thickness "ta" is out of the predetermined range, the process returns to step S21 to readjust the narrow gap N between the first test roller 1*a* and the second test roller 1*b*.

In step S27, the first recycling bucket 4*a* and the second recycling bucket 4*b* are emptied and the test apparatus 102 is again turned on. In step S28, the test apparatus 102 keeps operating for a predetermined time such that the liquid developer LD fills the first recycling bucket 4*a*, and the second recycling bucket 4*b*. In step S29, the test apparatus 102 is again turned off.

In step S30, the weight of the liquid developer LD "WH" in one of recycling buckets 4*a* and 4*b*, which attracts toner particles more than the other, and the weight "WL" of the other recycling bucket are measured. When the first test roller 1*a* rotates at a circumference velocity Sa(mm/second) contacting the first doctor blade 3*a* with a contact width Wa(mm), and the amount of the accumulated liquid developer in the first recycling buckets 4*a* in time Ta(seconds) is DWa(g), then the weight per unit area of the liquid developer LD on the first test roller 1*a* becomes Dwa/Sa·Ta·Wa(g/mm$^2$). Likewise, the weight per unit area of the liquid developer LD on the second test roller 1*b* is obtained as Dwb/Sb·Tb·Wb(g/mm$^2$) where the suffix "b" denotes the second test roller 1*b*. When the first test roller 1*a* attracts toner particles in the liquid developer LD, "WH" is Dwa/Sa·Ta·Wa, and "WL" is Dwb/Sb·Tb·Wb. When the first test roller 1*a* repels toner particles in the liquid developer LD, "WH" is Dwb/Sb·Tb·Wb, and "WL" is Dwa/Sa·Ta·Wa.

In step S31, the ratio "WL/WH" is calculated. When the ratio "WL/WH" is equal to or greater than zero and smaller than 0.71, the liquid developer LD tested in the above processes is determined as being sufficient to form an image with a decreased background soiling and an increased image density without using a dielectric release liquid or pre-wetting liquid.

In step S32, when an additional test remains, for example, a test with a different electric field strength in the narrow gap N, the process proceeds to step S33. In step S33, the electric field strength in the narrow gap N is changed from that in the previous test and the process returns to the step S21.

Figure 12:
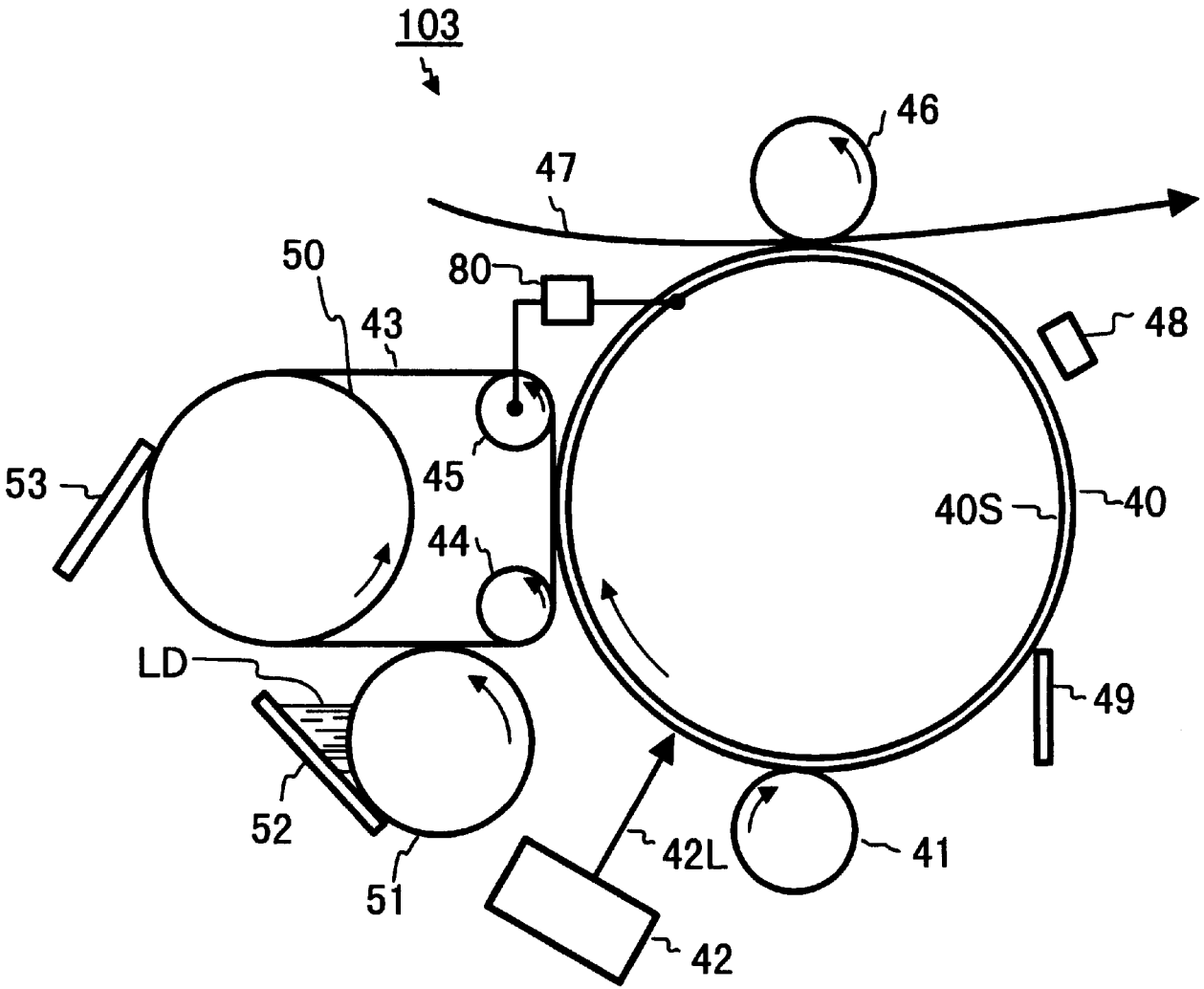
FIG. 12 is a schematic view illustrating a structure of an image forming apparatus according to an embodiment of the present invention.

FIG. 12 is a schematic view illustrating a structure of an image forming apparatus 103 using a narrow gap developing method according to the present invention. The image forming apparatus 103 includes a photoconductive drum 40, a charge roller 41, a writing system 42, a developing belt 43, conductive rollers 44 and 45, a transfer roller 46, a quenching lamp 48, a cleaning blade 49, a drive roller 50, a developer/coating roller 51, a liquid developer container 52, a doctor blade 53, and a power source 80.

The liquid developer LD in the developer container 52 has a ratio "tL/tH" or a ratio "WL/WH," which is equal to or greater than zero and smaller than 0.71, as tested by the test apparatus 101 of FIG. 1 or by the test apparatus 102 of FIG. 9.

During an image forming operation, each of the elements is rotated by a motor (not shown) in directions illustrated by the arrows in FIG. 12. The photoconductive drum 40 carries a latent image and a toner image. First, the charge roller 41 substantially uniformly charges the photoconductive drum 40 with a negative electric polarity. The writing system 42 includes, for example, a laser scanner which emits exposure light 42L according to an image signal and thereby a latent image is formed on the photoconductive drum 40.

The developing belt 43 is electrically conductive and conveys the liquid developer LD received from the developer coating roller 51 to a narrow gap formed at a region where the developing belt 43 contacts the photoconductive drum 40. The latent image on the photoconductive drum 40 is developed by the liquid developer LD at the narrow gap and a toner image is formed. The developing belt 43 is biased at an intermediate electric potential between the highest and the lowest electric potential of the latent image on the photoconductive drum 40 by the power source 80 via the conductive rollers 44 and 45. The area having the lowest electric potential of the latent image on the photoconductive drum 40 corresponds to an image portion having a maximum image density, and the area having the highest electric potential of the latent image corresponds to a non-image portion (i.e., a background portion). The area having an intermediate electric potential of the latent image on the photoconductive drum 40 corresponds to an image portion having an intermediate image density.

The liquid developer LD contains toner particles charged with a positive electric polarity. Therefore, toner particles in the liquid developer LD carried on the developing belt 43 move toward and deposit on the portion of the latent image having a lower electric potential on the photoconductive drum 40. On the other hand, toner particles in the liquid developer LD do not move toward to the photoconductive drum 40 at a portion of the latent image having a higher electric potential on the photoconductive drum 40 and remain on the developing belt 43. Further, a certain amount of the liquid developer LD carried by the developing belt 43 is moved toward and deposited on the photoconductive drum 40 and a certain amount of the liquid developer LD remains on the developing belt 43 at the narrow gap.

Figure 13:
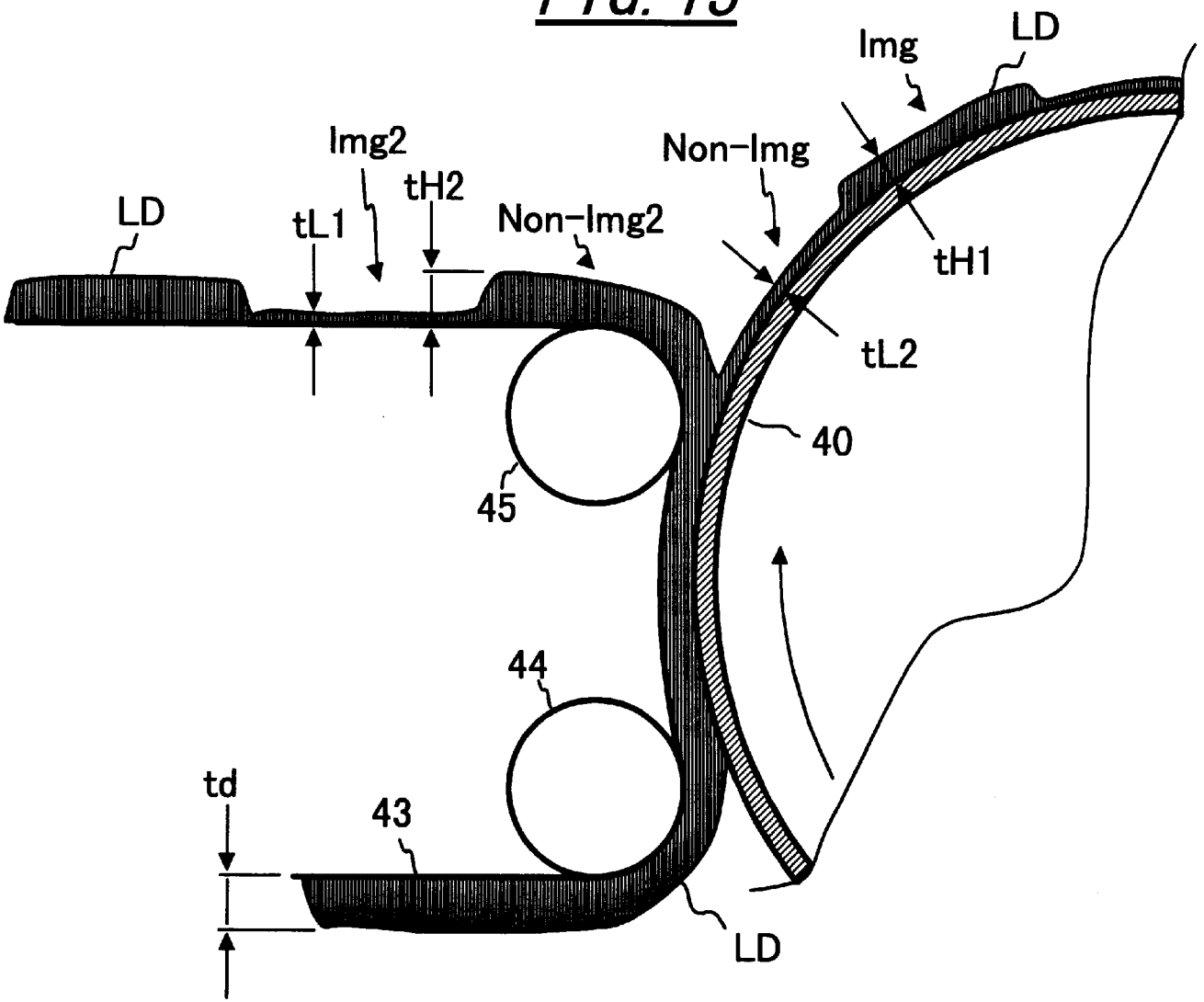
FIG. 13 is a schematic view illustrating a thickness of a liquid developer adhered to a photoconductive drum and a developing belt of the image forming apparatus of FIG. 12.

FIG. 13 illustrates a thickness of the liquid developer adhered to the photoconductive drum 40 and the developing belt 43 of the image forming apparatus 103 of FIG. 12. "Img" denotes an image portion on the photoconductive drum 40 having the electric potential lower than the bias voltage. "Non-Img" denotes a non-image portion (i.e., a background portion on the photoconductive drum 40 having the electric potential higher than the bias voltage).

"tH1" denotes the thickness of the liquid developer LD adhered to the image portion "Img" on the photoconductive drum 40. "tL1" denotes the thickness of the liquid developer LD adhered to an area "Img2" of the developing belt 43 that corresponds to the image portion "Img" on the photoconductive drum 40. As FIG. 13 shows, in the image portion "Img," the liquid developer LD on the photoconductive drum 40 is thicker than that on the developing belt 43, as indicated by "tH1" and "tL1." The ratio "tL1/tH1" is smaller than 0.71.

"tL2" denotes the thickness of the liquid developer LD adhered to the non-image portion "Non-lmg" on the photoconductive drum 40. "tH2" denotes the thickness of the liquid developer LD adhered to an area "Non-Img2" of the developing belt 43 that corresponds to the non-image portion "Non-Img" of the photoconductive drum 40. As FIG. 13 shows, in the non-image portion "Non-Img," the liquid developer LD adheres thicker on the area "Non-lmg2" of the developing belt 43 as "tH2" than on the photoconductive drum 40 as "tL2." The ratio "tL2/tH2" is also smaller than 0.71.

Referring again to FIG. 12, after development, the toner image on the photoconductive drum 40 is carried under the transfer roller 46 where a sheet of paper 47 is fed in. The transfer roller 46 transfers the toner image on the photoconductive drum 40 to the sheet of paper 47. After the transfer, the quenching lamp 48 irradiates the photoconductive drum 40 with light to discharge the electrical charge thereon. The doctor blade 49 removes the toner remaining on the photoconductive drum 40 to prepare for a next image forming operation.

In general, to reduce background soiling, it is practiced to, for example, pass the layer of a liquid developer on a developing roller through an electric field before a developing process starts. However, in this embodiment, a background soil quality is improved without such a process.

Figure 14:
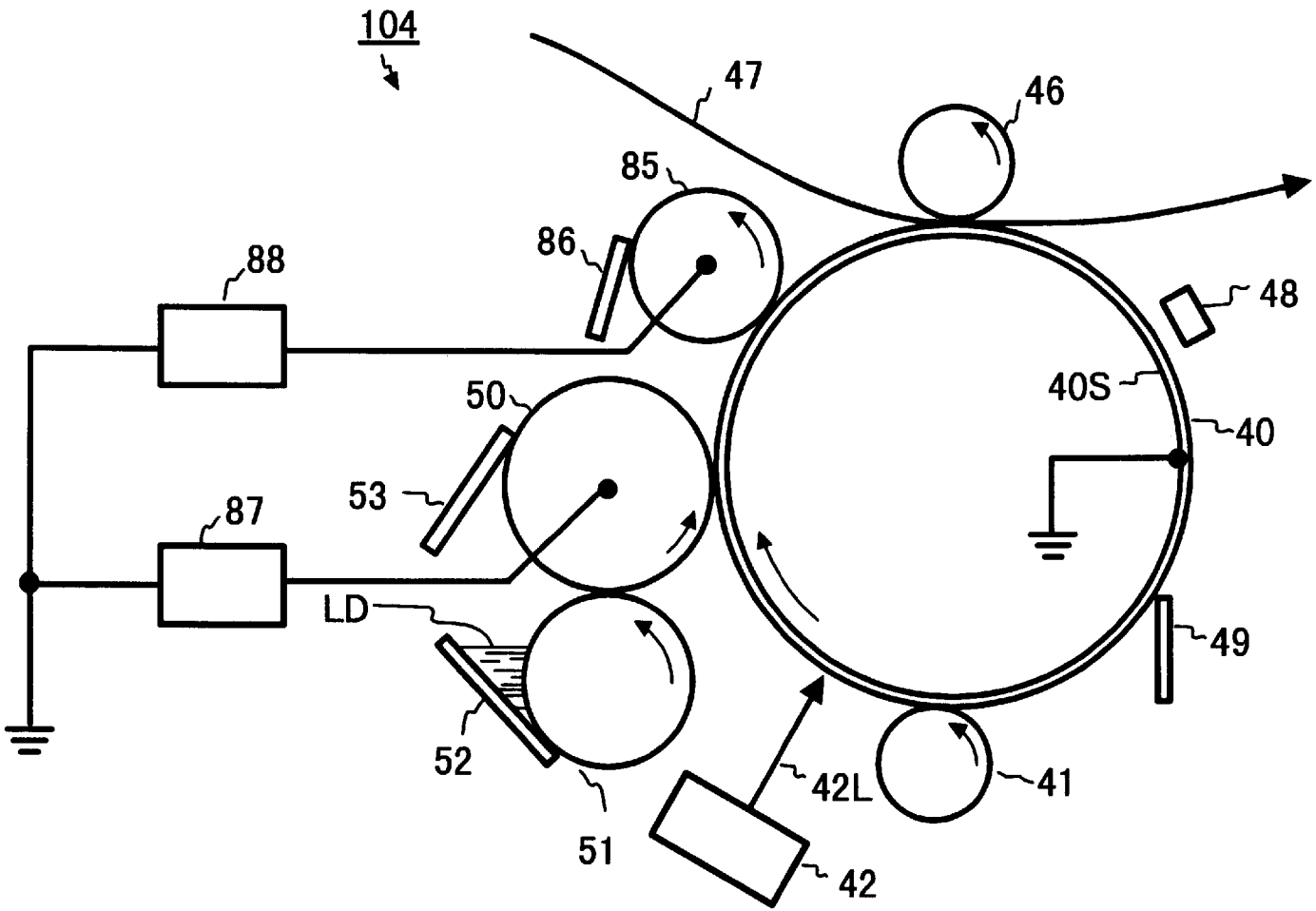
FIG. 14 is a schematic view illustrating a structure of an image forming apparatus according to another embodiment of the present invention.

FIG. 14 is a schematic view illustrating a structure of an image forming apparatus 104 according to another embodiment of the present invention. In FIG. 14, the elements that are substantially the same as those in FIG. 12 are denoted by the same reference numerals. Referring to FIG. 14, the image forming apparatus 104 includes a photoconductive drum 40, a charge roller 41, a writing system 42, a developing roller 50, an auxiliary developing roller 85, a transfer roller 46, a quenching lamp 48, a cleaning blade 49, a drive roller 50, a developer coating roller 51, a developer container 52, a first doctor blade 53, a second doctor blade 86, a first power source 87, and a second power source 88.

The developing roller 50 conveys the liquid developer LD received from the developer coating roller 51 to a narrow gap formed at a region where the developing roller 50 contacts the photoconductive drum 40. To set the narrow gap to a desirable length, the developing roller 50 may be constructed in a similar manner as the first test roller 1*a* and the second test roller 1*b* in FIG. 1. For example, the developing roller 50 may include a metal shaft covered with a rubber layer having a hardness of 20 to 60 degrees, preferably 20 to 40 degrees, as measured by a durometer method type A provided by the Japanese Industrial Standard K 6253, and have a thickness of 5 to 50 millimeters. Further, over the rubber layer, a conductive layer may be formed, for example, with a conductive polyamide system and desirably have a volume resistivity of $10^8$ ohm·cm or less and a thickness of 20 to 100 micrometers.

The developer coating roller 51 applies the liquid developer LD onto the developing roller 50 so as to form a layer of the liquid developer LD thereupon. The first power source 87 applies a voltage to the developing roller 50 such that a voltage on the surface of the developing roller 50 is biased at an intermediate voltage between the highest and the lowest voltage of the latent image on the photoconductive drum 40. A latent image on the photoconductive drum 40 is developed with the layer of the liquid developer LD and a toner image is thereby formed.

The auxiliary developing roller 85 may be constructed like the developing roller 50 or may be constructed with a solid metal. When the auxiliary developing roller 85 is constructed with a solid metal, the surface of the roller may be coated with an insulating layer. The second power source 88 applies a voltage to the auxiliary developing roller 85 such that a voltage on the surface of the auxiliary developing roller 85 is biased in an intermediate voltage between the highest and the lowest voltage of the latent image on the photoconductive drum 40. Because of the intermediate voltage, a certain amount of the liquid developer LD is moved from the photoconductive drum 40 and adhered to the auxiliary developing roller 85.

Figure 15:
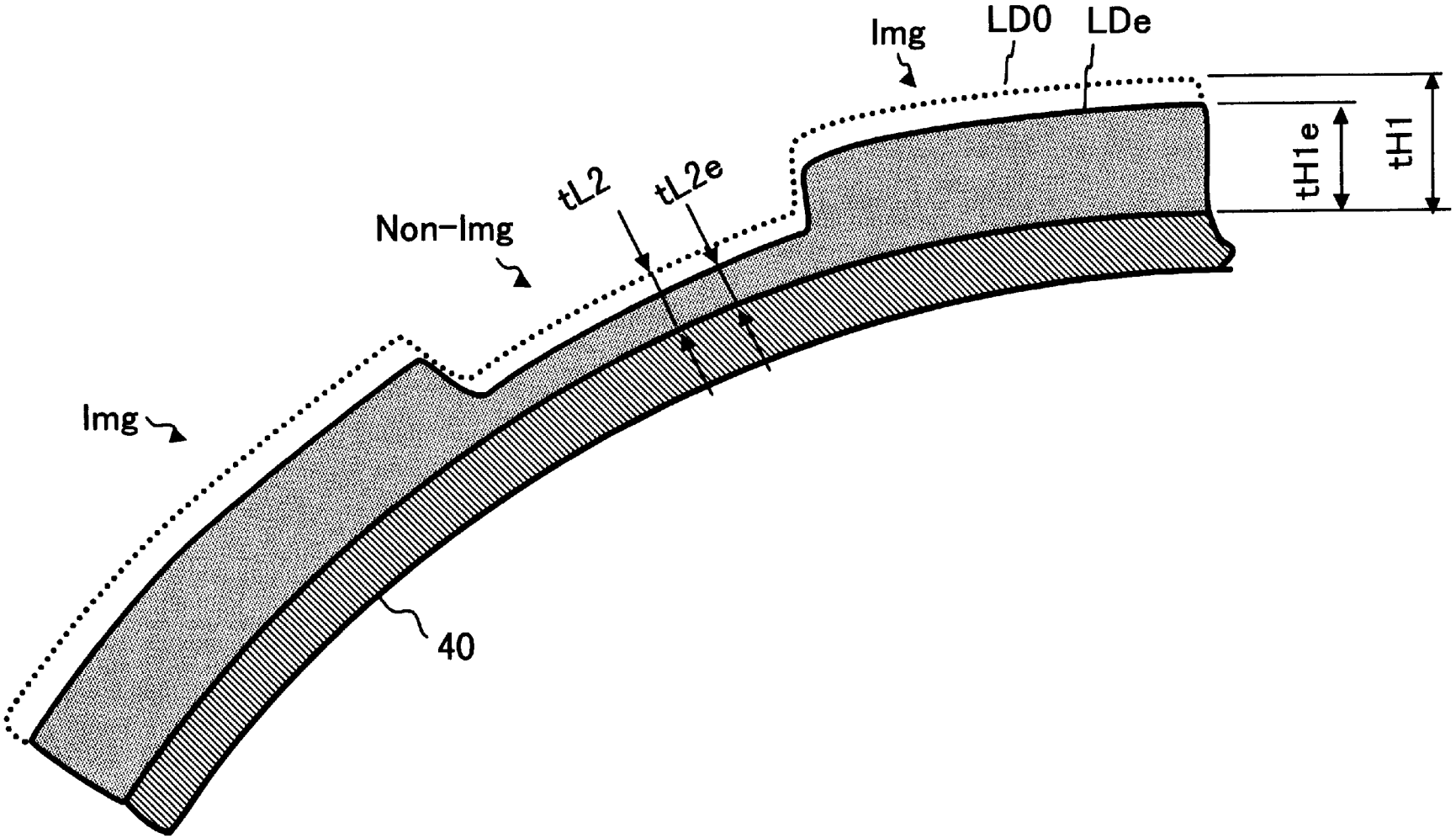
FIG. 15 is a schematic view illustrating a thickness of a liquid developer adhered to a photoconductive drum 40 before and after an auxiliary developing roller 85 of the image forming apparatus of FIG. 14.

FIG. 15 illustrates a thickness of liquid developer adhered to the photoconductive drum 40 before and after the auxiliary developing roller 85 of the image forming apparatus of FIG. 14. In FIG. 15, "LD0" denotes the liquid developer LD adhered to the photoconductive drum 40 upstream to the auxiliary developing roller 85 in the rotating direction of the photoconductive drum 40, and "LDe" denotes the liquid developer LD adhered to the photoconductive drum 40 downstream from the auxiliary developing roller 85 in the rotating direction of the photoconductive drum 40. The thickness of the liquid developer LD upstream to the auxiliary developing roller 85 is "tH1" at an image portion "Img" and "tL2" at a non-image portion "Non-Img." The thickness of the liquid developer LD downstream from the auxiliary developing roller 85 is "th1e" at an image portion "Img" and "tL2e" at a non-image portion "Non-Img." When the surface of the photoconductive drum 40 carrying the liquid developer layer passes under the auxiliary developing roller 85, the amount of the liquid developer LD on the image portion "Img" and the non-image portion "Non-Img" corresponding to the differences "tH1−tH1e" and "tL2−tL2e," respectively, are transferred to the auxiliary developing roller 85. Thus, the thickness of the layer of the liquid developer LD in the background portion is reduced and consequently the toner particles are removed. As a result, background soiling is further decreased.

The ratio of the thickness of the liquid developer LD on the developing roller 50 at the image portion divided by tH1 is smaller than 0.71, and the ratio tL2 divided by the thickness of the liquid developer LD on the developing roller 50 at the non-image portion is smaller than 0.71. In addition, the ratio of the combined thickness of the liquid developer LD on the developing roller 50 and on the auxiliary developing roller 85 at the image portion divided by th1e is smaller than 0.71. Likewise, the ratio of tL2e divided by the combined thickness of the liquid developer LD on the developing roller 50 and on the auxiliary developing roller 85 at the non-image portion is smaller than 0.71.

Furthermore, when the liquid developer LD of the present invention is used in the image forming apparatuses of the present invention, the density of toner particles in the liquid developer LD adhered to the photoconductive drum 40 is different between the image area and the non-image (i.e., the background area).

Figure 16:
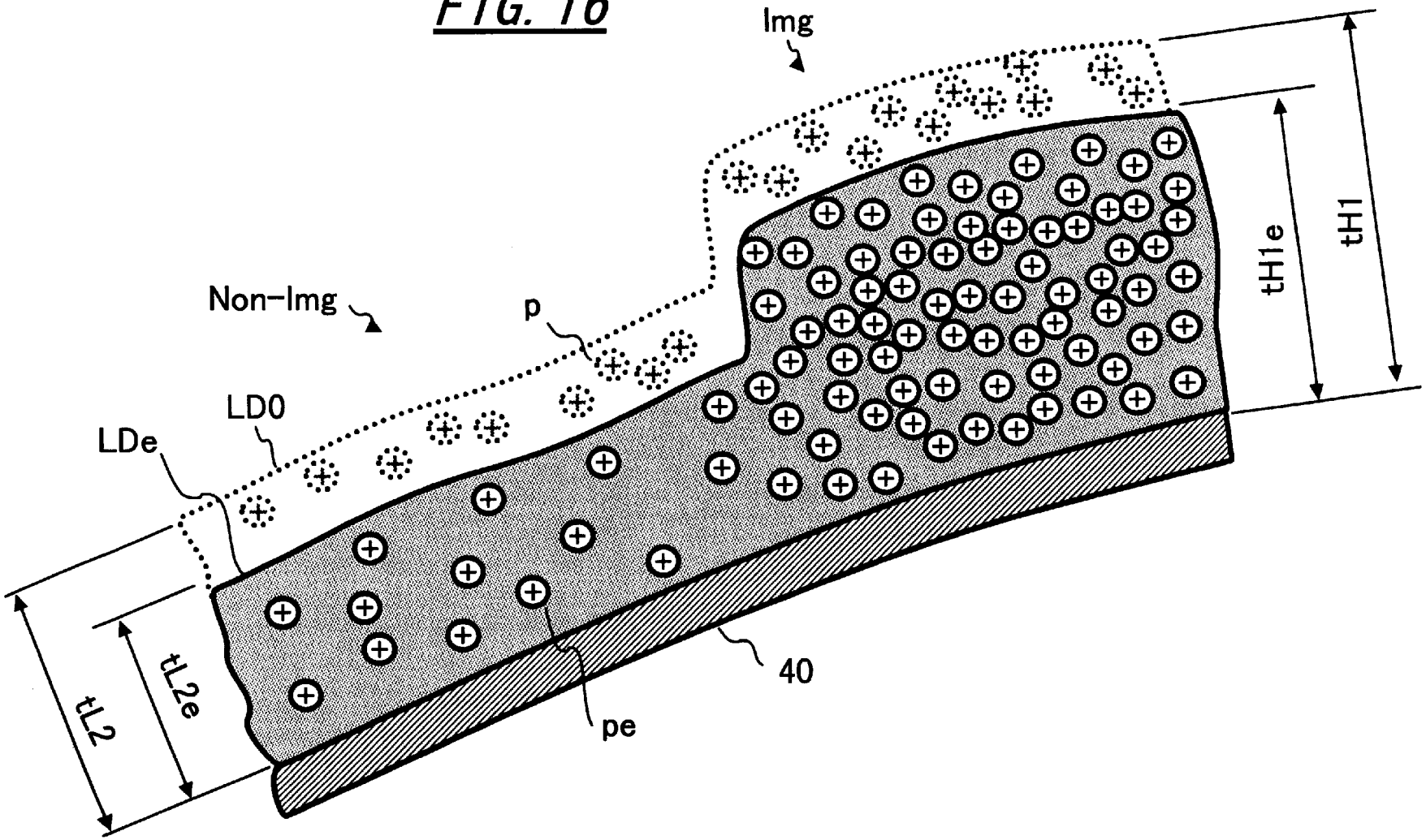
FIG. 16 is a schematic view illustrating a density of toner particles in the liquid developer adhered to the photoconductive drum 40 before and after the auxiliary developing roller 85 of the image forming apparatus of FIG. 14.

FIG. 16 is a schematic view illustrating the density of toner particles in the liquid developer LD adhered to the photoconductive drum 40 before and after the auxiliary developing roller 85 of the image forming apparatus 104 of FIG. 14. "P" denotes a toner particle in the liquid developer LD adhered to the photoconductive drum 40 before the auxiliary developing roller 85. "Pe" denotes the toner particle in the liquid developer LD adhered to the photoconductive drum 40 after the auxiliary developing roller 85. In both cases, the density of toner particles in the liquid developer LD adhered to the image area "Img" is higher than that in the liquid developer LD adhered to the non-image area "Non-Img." Because of this difference, the background soiling is further decreased and the image density is further increased.

Referring, again FIG. 1 and FIG. 9, the first test roller 1*a* and the second test roller 1*b* rotate at a circumference velocity S1 mm/sec and contact each other at the narrow gap having a width L1 mm. The difference of the electric potential between the two test rollers 1*a* and 1*b* is E1. On the other hand, referring again to FIG. 12 and FIG. 14, the photoconductive drum 40 rotates at a circumferential velocity S2 mm/sec and contacts the developer belt 43 or the developer roller 50 at the narrow gap having a width L2 mm. The difference of the electric potential between the photoconductive drum 40 and the developer belt 43 or the developer roller 50 is E2.

When liquid developer is tested by the test apparatus 101 of FIG. 1 or the test apparatus 102 of FIG. 9, and then following equation are satisfied:

$$(L2/S2)/(L1/S1) \leqq 1.1 \text{ and } 0.6 \times E2 \leqq E1 \leqq 1.2 \times E2,$$

the condition of the test apparatuses 101 and 102 is close to that of the actual image forming apparatuses.

As described above, the test methods of the present invention for testing characteristics of liquid developer can select liquid developer that forms an image with a decreased background soiling without using a dielectric release liquid and pre-wetting liquid.

Further, the image forming apparatus and method thereof of the present invention using the above liquid developer forms an image with a decreased background soiling without using a dielectric release liquid or pre-wetting liquid.

Obviously, numerous additional modifications and variations of the present invention are possible in light of the above teachings. In particular, features described for certain embodiments may be employed in a logical manner to other embodiments described herein. It is therefore to be understood that within the scope of the appended claims, the present invention may be practiced otherwise than as specifically described herein.

This document is based on Japanese patent application No. 10-211809 filed in the Japanese Patent Office on Jul. 10, 1998, the entire contents of which are hereby incorporated by reference.

What is claimed is:

1. An image forming method comprising:

forming a latent image having an image portion and a non-image portion on a moving image carrier;

moving a developing device in substantially a same direction and velocity as the moving image carrier in a vicinity of a narrow gap having a predetermined width between the moving image carrier and the developing device;

applying liquid developer including toner particles to the developing device at a position upstream from the narrow gap in a moving direction of the developing device such that the liquid developer passes through the narrow gap to develop the latent image; and generating an electric field in the narrow gap to deposit the liquid developer including the toner particles on the developing device and the image carrier such that, in the image portion, a ratio of a thickness or a weight per unit area of the liquid developer deposited on the developing device to a thickness or a weight per unit area of the liquid developer deposited on the image carrier is smaller than about 0.71, and in the non-image portion, a ratio of a thickness or a weight per unit area of the liquid developer deposited on the image carrier to a thickness or a weight per unit area of the liquid developer deposited on the developing device is smaller than about 0.71.

2. An image forming method comprising:

forming a latent image having an image portion and a non-image portion on a moving image carrier;

moving a developing device in substantially a same direction and velocity as the moving image carrier in a vicinity of a first narrow gap having a predetermined width between the moving image carrier and the developing device;

applying liquid developer including toner particles to the developing device at a position upstream from the first narrow gap in a moving direction of the developing device such that the liquid developer passes through the first narrow gap to develop the latent image;

generating a first electric field in the first narrow gap to deposit the liquid developer including the toner particles on the developing device and the image carrier such that, in the image portion, a ratio of a thickness or a weight per unit area of the liquid developer deposited on the developing device to a thickness or a weight per unit area of the liquid developer deposited on the image carrier is smaller than about 0.71, and in the non-image portion, a ratio of a thickness or a weight per unit area of the liquid developer deposited on the image carrier to a thickness or a weight per unit area of the liquid developer deposited on the developing device is smaller than about 0.71;

moving an auxiliary developing device in substantially a same direction as the moving image carrier in a vicinity of a second narrow gap having a predetermined width between the moving image carrier and the auxiliary developing device;

generating a second electric field in the second narrow gap such that the auxiliary developing device removes a part of the liquid developer that has been deposited at the first narrow gap on the image carrier in the step of generating the first electric field, such that a ratio of a thickness or a weight per unit area of combined liquid developer on the developing device and the auxiliary developing device to that of the liquid developer on the image carrier is smaller than 0.71 in the image portion, and a ratio of a thickness or a weight per unit area of the liquid developer on the image carrier to that of the combined liquid developer on the developing device and the auxiliary developing device is smaller than 0.71 in the non-image portion after the image is further developed at the second narrow gap.

3. An image forming apparatus comprising:

means for carrying a latent image having an image portion and a non-image portion, and a toner image;

means for holding liquid developer including toner particles;

means for developing the latent image on the image carrying means at a narrow gap having a predetermined width formed between the image carrying means and the developing means;

means for applying the liquid developer including the toner particles to the developing means at a position upstream from the narrow gap in a moving direction of the developing means; and means for generating an electric field in the narrow gap to deposit the liquid developer including toner particles on the developing means and the image carrying means such that, in the image portion, a ratio of a thickness or a weight per unit area of the liquid developer on the developing means to a thickness or a weight per unit area of the liquid developer on the image carrying means is smaller than about 0.71, and in the non-image portion, a ratio of a thickness or a weight per unit area of the liquid developer on the image carrying means to a thickness or a weight per a unit area of the liquid developer on the developing means is smaller than about 0.71.

4. The apparatus according to claim 3, wherein the developing means includes a conductive belt having an insulating coated layer on a surface facing the image carrying means.

5. The apparatus according to claim 3, wherein the developing means includes a roller having a shaft, an elastic layer around the shaft, and an external conductive layer around the elastic layer.

6. The apparatus according to claim 3, wherein the developing means includes a roller having an external diameter of about 20 mm to about 100 mm, an elastic layer included inside the roller with a hardness of about 20 to about 60 degrees and a thickness of about 5 mm to about 50 mm, and a conductive layer around the elastic layer and having a volume resistivity of about $10^8$ ohm·cm or smaller and a thickness of about 20 micrometers to about 100 micrometers.

7. An image forming apparatus comprising:

means for carrying a latent image having an image portion and a non-image portion and a toner image;

means for holding liquid developer including toner particles;

means for developing the latent image on the image carrying means at a first narrow gap having a predetermined width formed between the image carrying means and the developing means;

means for applying the liquid developer including the toner particles to the developing means at a position upstream from the first narrow gap in a moving direction of the developing means;

means for generating a first electric field in the first narrow gap to deposit the liquid developer including the toner particles on the developing means and the image carrying means such that, in the image portion, a ratio of a thickness or a weight per unit area of the liquid developer on the developing means to a thickness or a weight per unit area of the liquid developer on the image carrying means is smaller than about 0.71, and in the non-image portion, a ratio of a thickness or a weight per unit area of the liquid developer on the image carrying means to a thickness or a weight per unit area of the liquid developer on the developing means is smaller than about 0.71;

means for auxiliary developing the latent image, the auxiliary developing means moving substantially in a same direction as the image carrying means in a vicinity of a second narrow gap having a predetermined width between the image carrying means and the auxiliary developing means; and means for generating a second electric field in the second narrow gap such that the auxiliary developing means removes a part of the liquid developer that has been deposited at the first narrow gap on the image carrying means by the means for generating the first electric field, such that a ratio of a thickness or a weight per unit area of combined liquid developer on the developing means and the auxiliary developing means to that of the liquid developer on the image carrying means is smaller than 0.71 in the image portion, and a ratio of a thickness or a weight per unit area of the liquid developer on the image carrying means to that of the combined liquid developer on the developing means and the auxiliary developing means is smaller than 0.71 in the non-image portion after the image is further developed at the second narrow gap.

8. The apparatus according to claim 7, wherein the developing means includes one of 1) a conductive roller including an insulating coating layer and 2) a roller having a shaft, an elastic layer around the shaft, and an external conductive layer around the elastic layer, and wherein the auxiliary developing means includes one of 1) a conductive roller having an insulating coating layer and 2) a roller having a shaft, an elastic layer around the shaft, and an external conductive layer around the elastic layer.

9. An image forming apparatus comprising:

a photoconductive device that carries a latent image having an image portion and a non-image portion, and a toner image;

a container that contains liquid developer including toner particles;

a developing device that develops the latent image on the photoconductive device at a narrow gap having a predetermined width formed between the photoconductive device and the developing device;

a liquid developer-coating device that applies the liquid developer including the toner particles to the developing device at a position upstream from the narrow gap in a moving direction of the developing device; and a power source that generates an electric field in the narrow gap to deposit the liquid developer including the toner particles on the developing device and the photoconductive device such that, in the image portion, a ratio of a thickness or a weight per unit area of the liquid developer on the developing device to a thickness or a weight per unit area of the liquid developer on the image carrier is smaller than about 0.71, and in the non-image portion, a ratio of a thickness or a weight per unit area of the liquid developer on the photoconductive device to a thickness or a weight per unit area of the liquid developer on the developing device is smaller than about 0.71.

10. The apparatus according to claim 9, wherein the photoconductive device comprises a drum-shape and the developing device includes a conductive belt having an insulating coated layer on a surface facing the photoconductive device.

11. The apparatus according to claim 10, wherein the conductive belt moves in substantially a same direction and velocity as the photoconductive device at the narrow gap.

12. The apparatus according to claim 9, wherein the liquid developer-coating device includes a roller having a plurality of hollows on the surface thereof that carry the liquid developer from the container to the developing device.

13. The apparatus according to claim 12, wherein the roller of the liquid developer-coating rotates in a reverse direction to the developing device at a position the roller of the developer-coating device comes close to the developing device.

14. The apparatus according to claim 9, wherein the developing device includes a roller having an external diameter of about 20 mm to about 100 mm, an elastic layer included inside the roller with a hardness of about 20 to about 60 degrees and a thickness of about 5 mm to about 50 mm, and a conductive layer around the elastic layer and having a volume resistivity of $10^8$ ohm·cm or smaller and a thickness of about 20 micrometers to about 100 micrometers.

15. The apparatus according to claim 9, wherein the density of the toner particles is higher on the image portion than on the non-image portion of the latent image on the photoconductive device, and is caused by the electric field.

16. An image forming apparatus comprising:

a photoconductive device that carries a latent image having an image portion and a non-image portion, and a toner image;

a container that contains a liquid developer including toner particles;

a developing device that develops the latent image on the photoconductive device at a first narrow gap having a predetermined width formed between the photoconductive device and the developing device;

a liquid developer-coating device that applies the liquid developer including the toner particles to the developing device at a position upstream from the first narrow gap in a moving direction of the developing device;

a first power source that generates a first electric field in the first narrow gap to deposit the liquid developer including the toner particles on the developing device and the photoconductive device such that, in the image portion, a ratio of a thickness or a weight per unit area of the liquid developer on the developing device to a thickness or a weight per unit area of the liquid developer on the image carrier is smaller than about 0.71, and in the non-image portion, a ratio of a thickness or a weight per unit area of the liquid developer on the photoconductive device to a thickness or a weight per emit area of the liquid developer on the developing device is smaller than about 0.71;

an auxiliary developing device that auxiliary develops the latent image at a second narrow gap having a predetermined width formed between the photoconductive device and the auxiliary developing device; and a second power source that generates a second electric field in the second narrow gap, such that the auxiliary developing device removes a part of the liquid developer that has been deposited at the first narrow gap on the photoconductive device by the first power source, such that a ratio of a thickness or a weight per unit area of combined liquid developer on the developing device and the auxiliary developing device to that of the liquid developer on the photoconductive device is smaller than 0.71 in the image portion, and a ratio of a thickness or a weight per unit area of the liquid developer on the photoconductive device to that of the combined liquid developer on the developing device and the auxiliary developing device is smaller than 0.71 in the non-image portion after the image is further developed at the second narrow gap.

17. The apparatus according to claim 16, wherein the developing device includes a roller having an external diameter of about 20 mm to about 100 mm, an elastic layer included inside the roller having a hardness of about 20 to about 60 degrees and a thickness of about 5 mm to about 50 mm, and a conductive layer around the elastic layer having a volume resistivity of $10^8$ ohm·cm or smaller and a thickness of about 20 micrometers to about 100 micrometers, and wherein the auxiliary developing device includes a conductive roller having one of 1) an insulating coated layer and 2) a roller having a shaft, an elastic layer around the shaft, and an external conductive layer around the elastic layer.

18. The apparatus according to claim 16, wherein the density of the toner particles is higher on the image portion than on the non-image portion of the latent image on the photoconductive device, and is caused by the first and second electric fields.

* * * * *